US011239068B2

(12) United States Patent
Sugiyama et al.

(10) Patent No.: US 11,239,068 B2
(45) Date of Patent: Feb. 1, 2022

(54) INDUCTIVELY COUPLED PLASMA MASS SPECTROMETER WITH MASS CORRECTION

(71) Applicant: AGILENT TECHNOLOGIES, INC., Santa Clara, CA (US)

(72) Inventors: Naoki Sugiyama, Tokyo (JP); Amir Liba, Wilmington, DE (US); Mark Lee Kelinske, Waco, TX (US); Glenn David Woods, Glossop (GB)

(73) Assignee: Agilent Technologies, Inc., Santa Clara, CA (US)

( * ) Notice: Subject to any disclaimer, the term of this patent is extended or adjusted under 35 U.S.C. 154(b) by 63 days.

(21) Appl. No.: 16/545,920

(22) Filed: Aug. 20, 2019

(65) Prior Publication Data

US 2020/0144046 A1 May 7, 2020

Related U.S. Application Data

(60) Provisional application No. 62/754,672, filed on Nov. 2, 2018.

(51) Int. Cl.

*H01J 49/42* (2006.01)
*H01J 49/00* (2006.01)
*H01J 49/10* (2006.01)

(52) U.S. Cl.

CPC ..... *H01J 49/4215* (2013.01); *H01J 49/0027* (2013.01); *H01J 49/105* (2013.01)

(58) Field of Classification Search

CPC .. H01J 49/4215; H01J 49/0027; H01J 49/105; H01J 49/26; H01J 49/421

USPC ..... 250/281, 282, 288

See application file for complete search history.

(56) References Cited

U.S. PATENT DOCUMENTS 4,136,280 A * 1/1979 Hunt ..... H01J 49/0095 250/282
8,610,053 B2 * 12/2013 Yamada ..... H01J 49/24 250/281
10,665,438 B2 * 5/2020 Rottmann ..... H01J 49/0009
2011/0095176 A1 * 4/2011 Castro-Perez ..... H01J 49/26 250/282
2013/0334415 A1 * 12/2013 Sugawara ..... H01J 49/0009 250/288
2014/0361159 A1 * 12/2014 Pfaff ..... H01J 49/0036 250/282
2015/0187556 A1 * 7/2015 Shimura ..... H01J 49/105 250/282

OTHER PUBLICATIONS

Agilent Technologies, Inc., "Reaction data for 70 elements using O2, NH3 and H2 gases with the Agilent 8800 Triple Quadrupole ICP-MS" Technical Note, May 30, 2014, 14 pages (Year: 2014).*

(Continued)

*Primary Examiner* — Michael Maskell

(57) ABSTRACT

Systems and methods for controlling mass filtering of polyatomic ions in an ion beam passing through an inductively coupled plasma mass spectrometer (ICP-MS). Polyatomic ion mass data representative of the exact mass of a polyatomic ion having a target isotope is determined. A control signal is generated based on the determined polyatomic ion mass data and output to an ICP-MS to filter based on mass the polyatomic ions in the ion beam traveling through the ICP-MS to an ion detector.

20 Claims, 12 Drawing Sheets

(56) References Cited

OTHER PUBLICATIONS

Thermofisher Scientific, "Triple Quadrupole ICP-MS or Single Quadrupole ICP-MS? Which Instrument is Right for Me?" Product Brochure, 2017, 5 pages (Year: 2017).*
Agilent Technologies, Inc., "Agilent 8800 Triple Quadrupole ICP-MS: Understanding oxygen reaction mode in ICP-MS/MS" Technical Overview, Dec. 20, 2012, 8 Pages.
Agilent Technologies, Inc., "Agilent 8900 Triple Quadrupole ICP-MS", Hardware Maintenance Manual, May 2016, 184 pages.
Agilent Technologies, Inc., "Agilent MassHunter Software, Your Faster Route to Insight, The Measure of Confidence", Product Brochure, 2015, 7 pages.
Agilent Technologies, Inc., "MassHunter Optimizer Software for Automated MRM Method Development Using the Agilent 6400 Series Triple Quadrupole Mass Spectrometers" Technical Overview, Feb. 8, 2010, 6 Pages.
Agilent Technologies, Inc., "Raise Your Expectations With the Next Generation of ICP-MS" Product Brochure, Sep. 15, 2016, 8 Pages.
Agilent Technologies, Inc., "Reaction data for 70 elements using O2, NH3 and H2 gases with the Agilent 8800 Triple Quadrupole ICP-MS" Technical Note, May 30, 2014, 14 Pages.
Agilent Technologis, Inc., "Atomic Spectroscopy Applications in the Contract Environmental Laboratory", Primer, Sep. 1, 2016, 340 Pages.
Azo Materials, "Using Graphical Tools to Understand Quadrupole Theory", Azom, May 20, 2014, 10 Pages.
Busch, K., "Units in Mass Spectrometry", Spectroscopy, 16(11), Nov. 2001, 3 Pages.
Murray et al., "Definitions of terms relating to mass spectrometry (IUPAC Recommendations 2013)*", Pure Applied Chemistry, vol. 85 No. 7, pp. 1515-1609, Jun. 6, 2013, 95 Pages.
Perkin-Elmer, "The 30-Minute Guide to ICP-MS", Technical Note, 2004, 8 Pages.
Thermofisher Scientific, "Triple Quadrupole ICP-MS or Single Quadrupole ICP-MS? Which Instrument is Right for Me?" Product Brochure, 2017, 5 Pages.

* cited by examiner

300

| Mass Number (polyatomic ion) (1) | Exact Mass With mass deviation correction (amu) (2)=(1)+(3)+(4) | Δm: conventional mass deviation (amu) (3) | Mass deviation correction (amu) (4) | Polyatomic ion (target element isotope, cell gas) |
|---|---|---|---|---|
| 133 | 133.072785 | -0.094548 | 0.167333 | $Ti+NH_2(NH_3)_4$ $(Ti+, NH_3)$ |

310

FIG. 3A

320

| Mass Number | Exact Mass With mass deviation correction (amu) | Δm: conventional mass deviation (amu) | Single atomic ion |
|---|---|---|---|
| 133 | 132.905452 | -0.094548 | Cesium |

330

FIG. 3B

| Z+N: mass number | exact mass (amu) | Δm: mass deviation | Isotope |
|---|---|---|---|
| 1 | 1.007825 | 7.82E-03 | 1H |
| 2 | | | |
| 3 | | | |
| 4 | 4.002603 | 2.60E-03 | 4He |
| 5 | | | |
| 6 | 6.01512 | 1.51E-02 | 6Li |
| 7 | | | |
| 8 | | | |
| 9 | 9.012183 | 1.22E-02 | 9Be |
| 10 | | | |
| 11 | | | |
| 12 | 12 | 0.00E+00 | 12C |
| 13 | | | |
| 14 | | | |
| 15 | | | |
| 16 | 15.99492 | -5.08E-03 | 16O |
| 17 | | | |
| 18 | | | |
| 19 | | | |
| 20 | | | |
| 21 | | | |
| 22 | | | |
| 23 | | | |
| 24 | | | |
| 25 | | | |
| 26 | | | |
| 27 | | | |
| 28 | 27.97693 | -2.31E-02 | 28Si |
| 29 | | | |
| 30 | | | |
| 31 | | | |
| 32 | 31.97207 | -2.79E-02 | 32S |
| 33 | | | |
| 34 | | | |
| 35 | | | |
| 36 | | | |
| 37 | | | |
| 38 | | | |
| 39 | | | |
| 40 | 39.96259 | -3.74E-02 | 40Ca |
| 41 | | | |
| 42 | | | |
| 43 | | | |

INDUCTIVELY COUPLED PLASMA MASS SPECTROMETER WITH MASS CORRECTION

CROSS-REFERENCE TO RELATED APPLICATIONS

This application claims benefit of priority from U.S. Provisional Patent Application No. 62/754,672, filed on Nov. 2, 2018, the contents of which are incorporated herein by reference in their entirety.

TECHNICAL FIELD

The present disclosure relates generally to element analysis with mass spectrometers and applications using mass spectrometers.

DESCRIPTION

Mass spectrometers are used in a variety of applications to analyze target elements. Target elements can be included in polyatomic ions. Elemental analyzers use mass spectrometers to carry out an analysis of target elements. For example, a target element can be loaded in a sample under investigation. These samples can be in solid, liquid or gas form. In example applications, samples may be taken from soil, air, or water as part of an environmental analysis. Target elements can include heavy metals, toxic elements or other types of elements. In other applications, samples may be collected or tested as part of a quality control, manufacturing, chemical analysis or other type of application.

Inductively coupled plasma-mass spectrometry (ICP-MS) is often utilized for elemental analysis of a sample, such as to measure the concentration of trace metals in the sample. An ICP-MS system includes a plasma-based ion source to generate plasma to break molecules of the sample down to atoms and then ionize the atoms in preparation for the elemental analysis. In a typical operation, a liquid sample is nebulized, i.e., converted to an aerosol (a fine spray or mist) by a nebulizer (typically of the pneumatic assisted type) and the aerosolized sample is directed into a plasma plume generated by a plasma source. The plasma source often is configured as a flow-through plasma torch having two or more concentric tubes. Typically, a plasma-forming gas such as argon flows through an outer tube of the torch and is energized into a plasma by an appropriate energy source (typically a radio frequency (RF) powered load coil). The aerosolized sample flows through a coaxial central tube (or capillary) of the torch and is emitted into the as-generated plasma. Exposure to plasma breaks the sample molecules down to atoms, or alternatively partially breaks the sample molecules into molecular fragments, and ionizes the atoms or molecular fragments.

The resulting analyte ions, which are typically positively charged, are extracted from the plasma source and directed as an ion beam into a mass analyzer. A quadrupole mass analyzer applies a time-varying electrical field, or a combination of electrical and magnetic fields, to spectrally resolve ions of differing masses on the basis of their mass-to-charge (m/z) ratios, and an ion detector then counts each type of ion of a given m/z ratio arriving at the ion detector from the mass analyzer. As another example, a time of flight (TOF) mass analyzer measures the times of flight of ions drifting through a flight tube, from which m/z ratios may then be derived. The ICP-MS system then presents the data so acquired as a spectrum of mass (m/z ratio) peaks. The intensity of each peak is indicative of the concentration (abundance) of the corresponding element of the sample.

In a tandem quadrupole ICP-MS system (ICP-MS QQQ or simply ICP-QQQ), two mass analyzers are provided on opposite sides of a reactant/collision cell. The two mass analyzers may act as respective mass filters. In one conventional technique called mass shift, the two quadrupoles (Q1, Q2) are set to different values (Q2 not equal to Q1) to help avoid spectra interference.

In conventional approaches for element analysis using ICP-MS including ICP-QQQ, it is known to use an exact mass value of a target element in a single isotope form to set electronics, magnetic field, time of data acquisition and so on for the target element. The conventional exact mass given to each element isotope is defined by the following equation (1):

$$\text{Exact mass}=\text{Mass number}+\text{mass deviation}, \quad (1)$$

where mass number is the mass number of a target isotope, and mass deviation is a function of the mass number of the target isotope.

This equation (1) for determining an exact mass value is helpful to users configuring an element analyzer tool. A user can select the mass number of a target isotope which is a whole number easily remembered or known by the user. The elemental analyzer tool can look up the mass deviation value needed to obtain an exact mass value according to equation (1). In operation, mass analysis is carried out in ICP-MS systems where the target isotope is present in an ion beam passing through the ICP-MS system. The target isotope in the ion beam is filtered and detected in the ICP-MS system using the obtained exact mass.

For example, to analyze an arsenic isotope having mass number of 75, a user may select mass number 75 for 75As. To analyze a selenium isotope having mass number of 78, a user may select mass number 78 for 78Se. The elemental analyzer tool may sum the mass number and an appropriate mass deviation value (obtained from a table look up based on the mass number) to obtain an exact mass. The obtained exact mass is used to control mass analysis in an ICP-MS system. In some conventional systems, values for this mass deviation of a target element isotope are stored in a memory to allow calculation of an exact mass for a target element isotope from the mass number. In this way, even though the target element is an isotope, a user may still identify a target isotope of element by selecting or inputting a mass number value which is generally easier for a user to use, while the elemental analyzer tool obtains an exact mass value to more accurately analyze mass in an ion flow through an ICP-MS system.

However, in some ICP-MS applications, polyatomic ions are present in an ion flow. For example, polyatomic ions may occur from reactions of an ion flow with a reactant in a reactant cell. In this case, polyatomic ions need to be filtered and detected according to their exact mass. The conventional approach is to determine the mass number of the polyatomic ion and then use a mass deviation value of a single element having the same mass number as the polyatomic ion. The inventors recognized though that this conventional approach leads to errors and does not obtain the exact mass of a polyatomic ion.

For example, an ion beam having a target element isotope (titanium $Ti^+$ with a mass number 49), may react with ammonia ($NH_3$) in a reactant cell to produce an output beam of polyatomic ions, $49Ti^+NH_2(NH_3)_4$ with a mass number 133. This mass number 133 is the same as the mass number 133 for the element cesium (Cs). The conventional approach merely applies the available mass deviation value for Cs to the $Ti^{+}NH_2(NH_3)_4$ polyatomic ion. However, this leads to error. The mass deviation value for Cs (−0.094548 amu) summed with the mass number 133 of the polyatomic ion $Ti^{+}NH_2(NH_3)_4$ is not representative of the exact mass of the polyatomic ion and is not an exact mass of the polyatomic ion. As first recognized by the inventors, this conventional approach does not represent the exact mass of the polyatomic ion and its components, including a target element or isotope within the polyatomic ion.

Embodiments of the present invention overcome these problems and provide even more accurate element analysis.

Embodiments described herein include systems and methods for analyzing a target element using an exact mass determined for a polyatomic ion having the target element. In one feature, the exact mass determined takes into account the actual mass of the target element when included in a polyatomic ion. The exact mass determination in embodiments here are different from and more accurate than conventional exact mass determinations or known mass shifts based on a single atomic element. In one embodiment, an exact mass determination is a function of a mass number corresponding to the target polyatomic ion and a mass deviation correction corresponding to a reactant in a reaction cell. For example, the function can be a sum of a mass number corresponding to the target polyatomic ion and a mass deviation correction corresponding to a reactant in a reaction cell.

In a further embodiment, element analysis with the exact mass determination for a target element in a polyatomic ion, as described herein, is carried out in an ICP-MS system. In another feature, the exact mass determination for a target element in a polyatomic ion is used to set a quadrupole in the filtering of masses in an ICP-MS system. In examples, exact mass determination as described herein can be carried out in software, firmware, hardware, or any combination thereof and included as part of a controller for an ICP-MS system. In one example, a user-interface can be provided to enable to user input mass setting information to initiate mass correction as described herein for an element analysis of a target element isotope in a polyatomic ion. In any embodiment of the present invention, the exact mass can be used to filter in or out the ions of the calculated exact mass. For example, once the exact mass of a polyatomic ion is determined, the ICP-MS system can be set to retain ions in a mass range that includes the exact mass. Conversely, the ICP-MS can be set to filter out ions of such a mass range.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments of the present invention.

FIG. 3A is diagram of a look up table with polyatomic ion mass data according to an embodiment of the present disclosure.

FIG. 3B is diagram of a look up table with conventional single atomic ion mass and mass deviation data.

DESCRIPTION OF EXAMPLE EMBODIMENTS OF THE INVENTION

Figure 1:
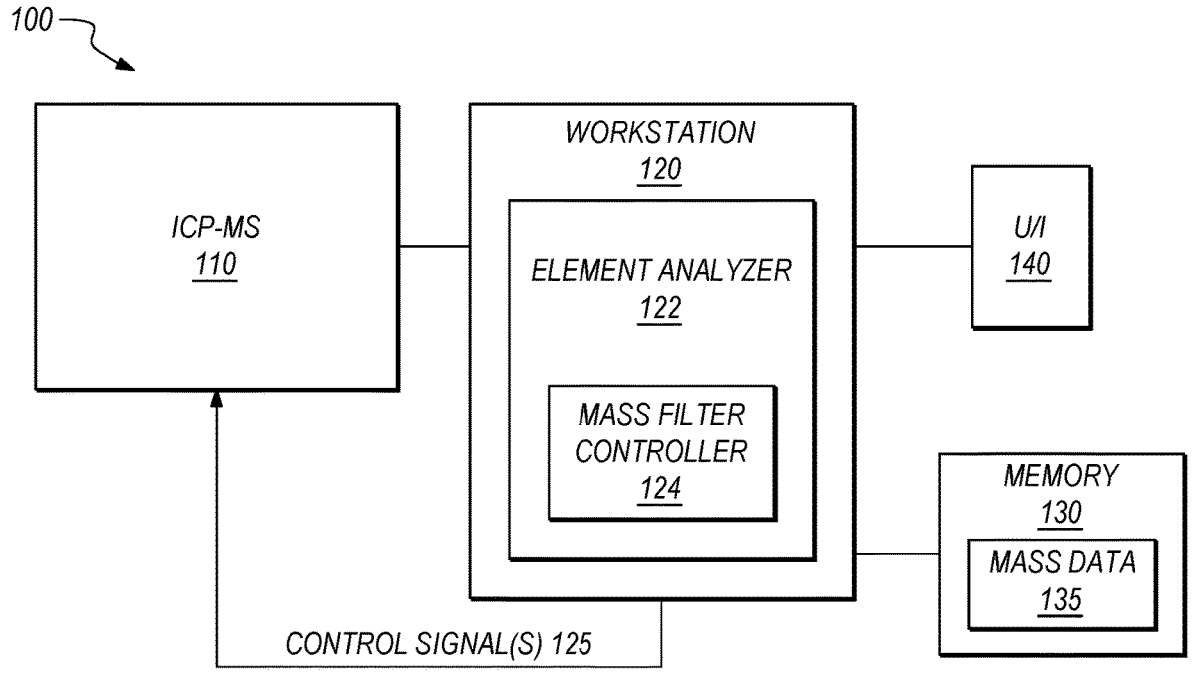
FIG. 1 is a diagram of a system having an element analyzer and a mass filter controller coupled to an inductively coupled plasma-mass spectrometer (ICP-MS) according to an embodiment of the present disclosure.

In the description of example embodiments that follows, references to "one embodiment", "an embodiment", "an example embodiment", "certain embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Overview

Systems and methods for analyzing a target element using an exact mass determined for a polyatomic ion having a target element are described in the present disclosure. In embodiments, an exact mass is determined for a target element in a polyatomic ion. In examples, this includes correcting for mass deviations that occur when target elements are present in polyatomic ions. Mass deviation corrections can be obtained for different target elements and different cell gases used in a collision/reactant cell.

In one embodiment, an exact mass determination is a function of a mass number corresponding to the target polyatomic ion and a mass deviation correction corresponding to a reactant in a reaction cell. In this way, according to a feature, an exact mass is determined for polyatomic ions, including polyatomic ions having target elements.

In embodiments, exact mass values determined with mass deviation corrections as described herein can be used to apply control signals for an ICP-MS system. For example, a control signal can include setting a quadrupole based on an exact mass determined for a polyatomic ion having a target element. Embodiments can include ICP-MS systems operated in on-mass mode or mass-shift mode. Embodiments include single quadrupole or triple quadrupole ICP-MS systems. In embodiments having a triple-quadrupole ICP-QQQ system the exact mass determined based on a mass deviation correction can be applied to set a second quadrupole mass analyzer (Q2 value) when Q2 not equal to Q1. In embodiments having a single quadrupole ICP-Q system the exact mass determined based on a mass deviation correction can be applied to set a quadrupole mass analyzer (Q value).

Several additional advantages that improve accuracy of measurement and element analysis are realized. First, a signal intensity is maximized since the polyatomic ion containing target atom/atomic ion is measured at an exact mass of the ion. Second, a stable and reproducible analysis is achieved since the target ion is measured at an exact peak top of the mass spectrometer. Finally, a linearity in a wide dynamic range is achieved when measuring a target isotope in the polyatomic ion containing it in a mass-shift method that avoids spectral interference. These advantages will be even more apparent in the description of further embodiments below.

Terminology

A "target element" as used herein refers to an atomic element, including but not limited to, any isotope, ion, or isotopic ion of an atomic element. Target elements can include heavy metals, toxic elements, chemical elements, or other types of elements.

A "target isotope" or "target element isotope" refers to an isotope of a target element.

Mass Related Terminology

As used herein the term "mass number" for an element refers to the total number of protons (Z) and neutrons (N) in an atomic nucleus and is equal to Z+N.

As used herein the term "exact mass" refers to a mass of an atom, molecule or compound (or their ions) composed of neutrons, protons and electrons. For example, an exact mass of a polyatomic ion as used herein can be a calculated mass of a polyatomic ion composed of neutrons, protons and electrons with a specified isotopic composition.

As used herein the term "mass deviation" refers to a difference between the exact mass and mass number.

As used herein the term "mass deviation correction" refers to a correction of mass that takes into account a change of mass when a target element is present in a polyatomic ion (such as, a target isotope in a polyatomic ion) as described in the present disclosure.

ICP-MS Terminology

As used herein, the term "fluid" is used in a general sense to refer to any material that is flowable through a conduit. Thus, the term "fluid" may generally refer to either a liquid or a gas, unless specified otherwise or the context dictates otherwise.

As used herein, the term "liquid" may generally refer to a solution, a suspension, or an emulsion. Solid particles and/or gas bubbles may be present in the liquid.

As used herein, the term "aerosol" generally refers to an assembly of liquid droplets and/or solid particles suspended in a gaseous medium long enough to be observed and measured. The size of aerosol droplets or particles is typically on the order of micrometers (μm). An aerosol may thus be considered as comprising liquid droplets and/or solid particles and a gas that entrains or carries the liquid droplets and/or solid particles.

As used herein, the term "atomization" refers to the process of breaking molecules down to atoms. Atomization may be carried out, for example, in a plasma enhanced environment. In the case of a liquid sample, "atomizing" may entail nebulizing the liquid sample to form an aerosol, followed by exposing the aerosol to plasma or to heat from the plasma.

As used herein, a "liquid sample" includes one or more different types of analytes of interest dissolved or otherwise carried in a liquid matrix. The liquid matrix includes matrix components. Examples of "matrix components" include, but are not limited to, water and/or other solvents, acids, soluble materials such as salts and/or dissolved solids, undissolved solids or particulates, and any other compounds that are not of analytical interest.

For convenience in the present disclosure, unless specified otherwise or the context dictates otherwise, a "collision/reaction cell" refers to a collision cell, a reaction cell, or a collision/reaction cell configured to operate as both a collision cell and a reaction cell, such as by being switchable between a collision mode and a reaction mode.

For convenience in the present disclosure, unless specified otherwise or the context dictates otherwise, a "collision/reaction gas" refers to an inert collision gas utilized to collide with ions in a collision/reaction cell without reacting with such ions, or a reactive gas utilized to react with analyte ions or interfering ions in a collision/reaction cell.

As used herein, the term "analyte ion" generally refers to any ion produced by ionizing a component of a sample being analyzed. In the specific context of ICP-MS, analyte ions are typically positive monatomic ions of a metal or other element except for a rare (noble) gas (e.g., argon), or are product ions produced by reacting a collision/reaction gas with positive monatomic ions of a metal or other element except for a rare gas.

Element Analyzer System using ICP-MS

FIG. 1 is a diagram of an element analyzer system 100 according to an embodiment. System 100 includes an inductively coupled plasma mass spectrometer (ICP-MS) 110 coupled to a workstation 120. An ion source and interface (not shown) can be used to generate an ion beam along a path into ICP-MS 110. A sample can be introduced into the ion beam path as well to introduce elements for analysis. Workstation 120 includes an element analyzer 122 and mass filter controller 124. Workstation 120 is coupled to a memory 130 and user-interface 140. Memory 130 stores mass data 135.

In an embodiment, workstation 120 is a computing device having one or more processors coupled to memory, including but not limited to memory 130, and to user-interface 140. Workstation 130 can be any type of computing device including a computer (desktop, tablet, or handheld device), or combination of computing devices. Element analyzer 122 and mass filter controller 124 can each be implemented in software, hardware, firmware or a combination thereof. User-interface 140 enables a user to input selections to element analyzer 122 for analyzing a target isotope including in a polyatomic ion. User-interface 140 can be coupled to peripheral devices to input and out data such as a keyboard, touchscreen, mouse, trackpad, microphone, speaker or other user input or output device.

ICP-MS 110 can be any type of inductively coupled plasma mass spectrometer including but not limited to, a single or triple quadrupole MS (ICP-Q or ICP-QQQ), or a MS using time of flight, magnetic sector, or other technique to separate ions based on mass such as a mass/charge ratio. Workstation 120 is coupled to ICP-MS 110 to provide one or more control signals to control ICP-MS 110. Workstation 120 also receives data from ICP-MS 110 for further processing and analysis by element analyzer 122. For example, ICP-MS 110 may include an ion detector that detects polyatomic ions having a target isotope in a filtered ion beam incident on the ion detector. The ion detector generates raw data, pre-processes the raw data, and outputs the raw data or pre-processed raw data representative of the detected polyatomic ions to element analyzer 122 for analysis, storage and display to users.

In one example, element analyzer 122 is a tool that controls ICP-MS 110 to detect analyte ions in an ion beam passing through ICP-MS 110. Analyte ions have target elements. These target elements include different isotopes of elements (also called target isotopes) being analyzed. Analyte ions can include polyatomic ions. Polyatomic ions having a target element are formed when the ion beam passes through a collision or reaction cell having a cell gas. The polyatomic ions can also include different target isotopes being analyzed.

Figure 2:
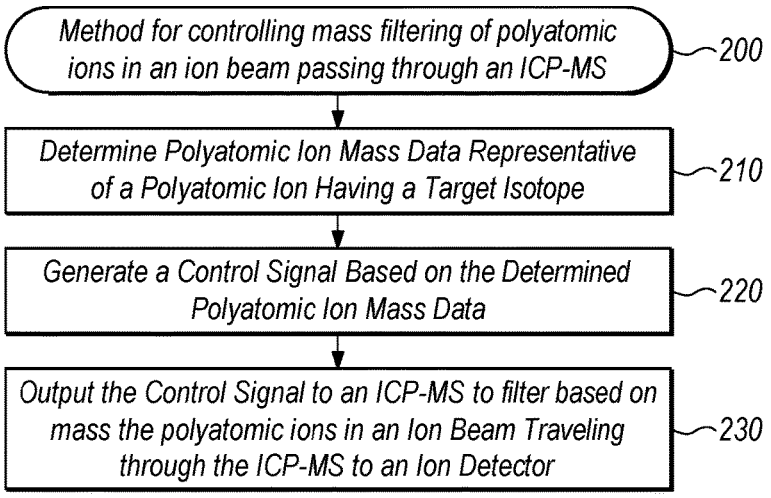
FIG. 2 is a flow diagram illustrating a method for controlling mass filtering of polyatomic ions in an ion beam passing through an ICP-MS according to an embodiment of the present disclosure.

In one feature, element analyzer 122 includes mass filter controller 124. FIG. 2 is a flowchart diagram of a method for controlling mass filtering of polyatomic ions 200 according to an embodiment (steps 210-230). For brevity, the operation of mass filter controller 124 is also described with respect to the routine shown in FIG. 2 and examples of table data in FIG. 3A and 3B. The methods of FIG. 2 and example data of FIGS. 3A-3B however are not intended to be limited to the system of FIG. 1 and can be used in other configurations as would be apparent to a person skilled in the art given this description. Likewise, the system of FIG. 1 is not necessarily intended to be limited to the methods of FIG. 2 and example data of FIGS. 3A and 3B.

In one embodiment, mass filter controller 124 determines polyatomic ion mass data representative of a polyatomic ion having a target isotope (step 210), and generates one or more control signals 125 based on the determined polyatomic ion mass data (step 220). Mass filter controller 124 outputs the control signal(s) 125 to ICP-MS 110 to filter based on mass the polyatomic ions in the ion beam traveling through ICP-MS 110 to an ion detector (step 230). In one example, mass filter controller 124 is implemented on one or more processors coupled to user-interface 140 and is configured to receive data representative of the input selections to element analyzer 122. The input selections can include for example selections identifying a cell gas and target isotope being analyzed.

In one embodiment, mass filter controller 124 determines polyatomic ion mass data equal to the exact mass of the polyatomic ion having the target isotope. Mass data 135 may store mass data including the polyatomic ion mass data. In one embodiment, mass filter controller 124 can access the polyatomic ion mass data 135 stored in memory 130 to determine the exact mass of the polyatomic ion having the target isotope. For example, mass filter controller 124 may perform a table look up to determine the exact mass of the polyatomic ion having the target isotope. In another embodiment, mass filter controller 124 can calculate the exact mass of the polyatomic ion having the target isotope. For example, these exact masses can be determined from the input selections identifying a cell gas and target isotope being analyzed.

In a further embodiment, mass data 135 may store mass deviation correction data in memory 130. The mass deviation correction data is based on a target isotope and a cell gas used in the ICP-MS to form the polyatomic ions in the ion beam. The mass deviation correction data can be a correction to conventional mass data determined for single atomic ions, elements and isotopes. In this way, the mass deviation correction data can be summed with conventional mass data to determine polyatomic ion mass data equal to the exact mass of the polyatomic ion having the target isotope.

For example, as shown in FIG. 3A, memory 130 may store a table 300. Table 300 may include rows of entries of mass data for different polyatomic ions. In one example, a row may include several fields or columns with the following information for a polyatomic ion: mass number, exact mass (amu units), mass deviation ($\Delta m$) in amu units, mass deviation correction in amu units, and polyatomic ion identifier. The polyatomic ion identifier can be any identifier of a particular polyatomic ion. In an example, this identifier can include a target element isotope value and cell gas value that allow a polyatomic ion to be determined.

In one example, mass filter controller 124 can perform a look up of table 300 to obtain mass deviation correction data for a particular polyatomic ion. This looked up mass deviation correction data can be summed with conventional mass data to determine polyatomic ion mass data equal to the exact mass of the polyatomic ion having the target isotope.

In contrast, as shown in FIG. 3B, for conventional exact mass determinations memory 130 may store a table 320 with conventional exact mass data for single atomic ions. Table 320 may include rows of entries of mass data for single atomic ions. In one example, a row may include several fields or columns with the following information for a single atomic ion: mass number, exact mass (amu units), mass deviation ($\Delta m$) in amu units, and single atomic ion identifier.

Mass filter controller 124 further outputs the generated one or more control signals 125 to ICP-MS 110. The type of control signal 125 generated sets the mass filtering used in ICP-MS 110. In one embodiment, ICP-MS 110 is a single quadrupole ICP-MS having a mass analyzer controlled according to a quadrupole Q value. Mass filter controller 124 generates a control signal 125 identifying a Q value according to the determined polyatomic ion mass data, and outputs the control signal to the mass analyzer to control mass filtering of the ion beam passing through ICP-MS 110.

In another embodiment, ICP-MS 110 is a triple quadrupole ICP-MS having first and second mass analyzers controlled to filter ion masses in an ion beam passing through the ICP-MS 110 according to respective first and second quadrupoles Q1 and Q2. In an embodiment, mass filter controller 124 generates a control signal 125 identifying a Q2 value according to the determined polyatomic ion mass data, and outputs control signal 125 to the second mass analyzer to control mass filtering of the ion beam passing through ICP-MS 110. Other quadrupole values (Q1) for the first mass analyzer and a Q value for a reactant cell between the first and second mass analyzers can be set according to conventional techniques. In one example, mass filter controller 124 generates a control signal 125 identifying a Q2 value according to the determined polyatomic ion mass data when Q2 is not equal to Q1 such as when a triple quadrupole ICP-MS is operated in a mass shift mode to reduce spectral interference.

In embodiments, mass filter controller 124 may be configured to output a control signal 125 to a mass analyzer to control one or more voltage signals applied to the mass analyzer. For example, mass filter controller 124 may be configured to output a control signal 125 to a power supply coupled to a mass analyzer. The power supply may then generate one or more voltage signals based on the received control signals. In one implementation, the one or more voltage signals may be a DC voltage signal (U) and an AC voltage signal (Vp). For example, the U and Vp voltages can be applied to quadrupole electrodes in the second mass analyzer (according to Q2) to control mass filtering of the ion beam passing through the second mass analyzer. In this way, voltage signals may be generated which take into account the determined polyatomic ion mass data and as a result can filter ions in the ion beam even more accurately.

Example Polyatomic Ions and Cell Gases

In embodiments, a cell gas can include any of the following known cell gases: Ammonia ($NH_3$), Oxygen ($O_2$), Methane ($CH_4$), Ethane ($C_2H_6$), Propane ($C_2H_8$), Fluoromethane ($CH_3F$), Tetrafluoromethane ($CF_4$), Nitric Oxide (NO), Nitrous Oxide ($N_2O$), Carbon Monoxide (CO), Carbon Dioxide ($CO_2$), Acetylene ($C_2H_2$), Propylene ($C_3H_6$), Nitrogen ($N_2$), Argon (Ar), Neon (Ne), Xenon (Xe), Kyrpton (Kr), Hydrogen ($H_2$), and Helium (He). See, e.g, *Agilent* 8900 *Triple Quadrupole ICP-MS, Hardware Maintenance Manual,* published by Agilent Technologies, Inc. 2016, Appendix A, Table 5, pp. 128-129. Examples of target element isotopes and their resultant polyatomic ions may also include elemental ions and reaction product ions described by N. Sugiyama and K. Nakano, *Reaction Data for* 70 *Elements Using O*2, *NH*3, *and H*2 *gases with the Agilent* 8800 *Triple Quadrupole ICP-MS, Technical Note,* published by Agilent Technologies, Inc. 2014, Tables 2A-2B, pp. 6-13. Example elements (denoted by M) which can be used as target element ions including available isotopes of these elements are the following: Li, Be, B, Na, Mg, Al, Si, P, S, Cl, K, Ca, Sc, Ti, V, Cr, Mn, Fe, Co, Ni, Cu, Zn, Ga, Ge, As, Se, Br, Rb, Sr, Y, Zr, Nb, Mo, Ru, Rh, Pd, Ag, Cd, Sn, Sb, Te, I, Cs, La, Ce, Pr, Nd, Sm, Eu, Gd, Tb, Dy, Ho, Er, Tm, Yb, Lu, Hf, Ta, W, Re, Ir, Pt, Au, Hg, Tl, Pb, Bi, Th, and U. For example, the following target elements and isotopes (M) can be included within polyatomic ions formed from reactants produced by three different cells gases $H_2$, $O_2$, and $NH_3$ as would be apparent to a person skilled in the art given this description. See, id. Such example polyatomic ions can be formed from reacting with each cell gas as follows: for hydrogen $H_2$: M+, MH+, $MH_2$+, $MH_3$+; for oxygen $O_2$: M+, MO+, $MO_2$+, $MO_3$+, and ammonia $NH_3$: M+, M(NH)+, $M(NH_2)$+, $M(NH_3)$+, $MNH(NH_3)$+, $MNH_2(NH_3)$+, $M(NH_3)_2$+, $MNH(NH_3)_2$+, $MNH_2(NH_3)_2$+, and $M(NH_3)_3$+. See, id. These embodiments and examples are illustrative and not intended to limit the present invention.

Further examples of values of exact mass determined for specific isotopes and cell gases used in elemental analysis of target isotopes in polyatomic ions are described below. Unless otherwise indicated, the numeric values provided for exact mass, mass deviation, and mass deviation correction in the examples herein are in atomic mass units (amu). One amu (also referred to as u or Da) is a standard unit of mass equal to $1.66053\times10^{-27}$ kilograms (kg), and is 1/12 the mass of an atom of carbon C.

Titanium (Ti) Isotope with Ammonia ($NH_3$) Cell Gas

In one example, a target isotope ($^{49}Ti^+$) is detected in a polyatomic ion as Ti+ $NH_2(NH_3)_4$. This can be carried out in an ICP-MS system away from spectra interference of $^{32}S^{16}OH^+$ and $^{31}P^{18}O$+ on the original mass number of 49. In a triple quad, Q1 is controlled to allow ions having a mass number of 49 (using conventional exact mass calculation) to pass through. So ions having mass of 49, including target $^{49}Ti^+$ and interfering ions $^{31}P^{18}O^+/^{32}S^{16}OH^+$ pass thru the Q1 mass analyzer filter and enter a reaction cell filled with $NH_3$ gases. Only $^{49}Ti^+$ reacts with $NH_3$ to form $Ti^+NH_2(NH_3)_4$. A second quadrupole setting Q2 is set at mass number of 133 to allow only $Ti^+NH_2(NH_3)_4$ polyatomic ions to pass to an ion detector.

When Q2 is not equal to Q1, the target element isotope is measured by an exact mass determination of a polyatomic ion containing it rather than a calculation that uses using an exact mass corresponding to a single atom or atomic ion having the same atomic number as the polyatomic ion. Based on the exact mass determination an amplitude or frequency of a RF and DC voltage is applied to a quadrupole setting Q2 for a mass analyzer to accurately measure and generate an output signal for the polyatomic ion $Ti^+NH_2(NH_3)_4$.

In an embodiment, the exact mass number of $Ti^+NH_2(NH_3)_4$ is calculated following the formula given below from the mass number.

When the cell gas is ammonia $NH_3$, the following calculation is applied:

A target product ion is expressed as $T^+(NH_3)_i$, $T^+H(NH_3)_i$, $T^+N(NH_3)_i$, $Ti^+NH(NH_3)_i$, or $T^+NH_2(NH_3)_i$, where T is a target isotope to be measured, e.g., T=$^{49}$Ti and i=0, 1, 2, or 3.

Ma: Mass number of target element isotope, Mp: Mass number of polyatomic ion containing the target isotope.

EMa: Exact mass of target element isotope, EMp: Exact mass of polyatomic ion containing the target isotope.

Num of N: Number of Nitrogen atom contained in the polyatomic ion.

Num of H: Number of Hydrogen atom contained in the polyatomic ion.

EMn: exact mass of Nitrogen isotope 14N atom, EMn=14.003074

EMh: exact mass of hydrogen isotope 1 H atom, EMh=1.007825 N1=INT (Mp−Ma)/17; *) INT (A) is maximum integer which doesn't exceed A.

N2=Mp−Ma−17*N1

If N1×17=Mp−Ma; Target product ion is $T^+(NH_3)N1$, then 'Num of N'=N1, 'Num of H'=3×N1

If N2=14; Target product ion is $T^+N(NH_3)N1$, then 'Num of N'=N1+1, 'Num of H'=3×N1

If N2=15; Target product ion is $T^+NH(NH_3)N1$, then 'Num of N'=N1+1, 'Num of H'=3×N1+1

If N2=16; Target product ion is $T^+NH_2(NH_3)N1$, then 'Num of N'=N1+1, 'Num of H'=3×N1+2

If not either of above; Target product ion is $T^+H(NH_3)N1$, then 'Num of N'=N1, Num of H=Mp−Ma−14×'Num of N'

EMp=EMa+EMn×'Num of N'+EMh×'Num of H')

In this case, when $NH_3$ cell gas is used; $^{49}Ti^+NH_2(NH_3)_4$ is formed. Mass number of the polyatomic ion is 133, and the exact mass determined and used is 133.072785.

Figure 14:
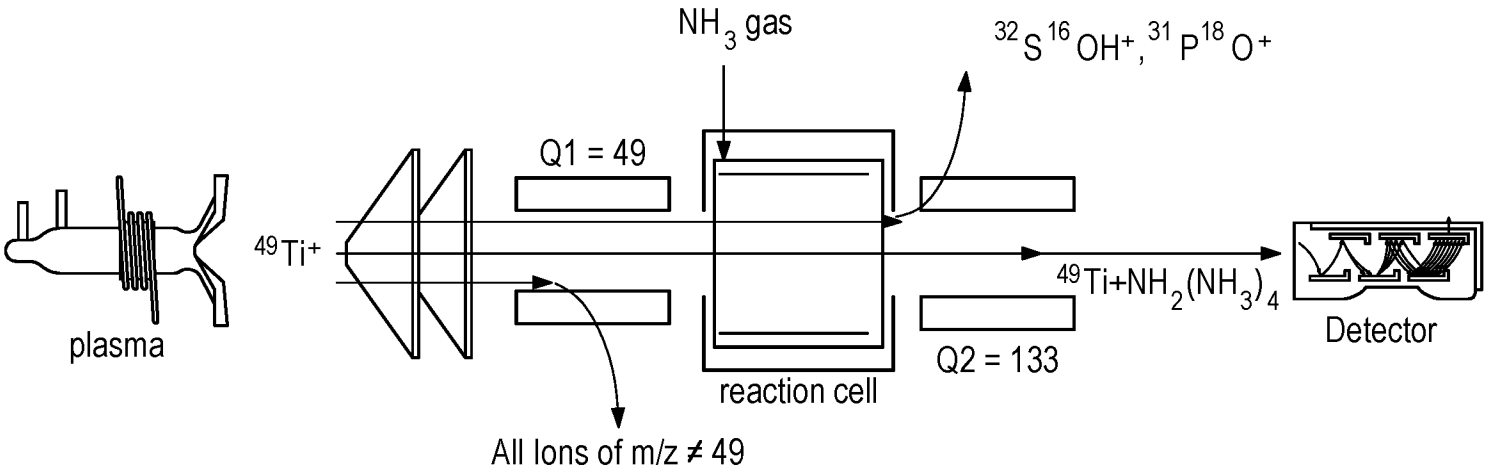
FIG. 14 illustrates an example of mass filtering in an ICP-QQQ system to measure $^{49}Ti^{+}$ as $^{49}Ti^{+}NH_2(NH_3)_4$ to resolve spectra interference by $SOH^{+}$ and $PO^{+}$ ions with ions on the original atomic mass number of 49.

FIG. 14 shows a diagram of an example element analyzer system to measure an isotope of titanium (Ti), $^{49}$Ti as $Ti^+NH_2(NH_3)_4$ in an ICP-MS/MS using $NH_3$ cell gas as a reactant in a reaction cell. Mass number of the polyatomic ion is 133 (Sum of mass number=49+14×5+1×14=133). In the method, Q1 is set at mass number 49 (exact mass is 48.947865 according to conventional calculation as described in step 734 below) to allow ions having mass number of 49 to pass. Q2 is set at mass number of 133 to allow ions having mass number of 133 (exact mass number by conventional calculation is 132.905452) to pass to the detector. The reaction cell is filled with $NH_3$ gas, where target ion $^{49}Ti^+$reacts with $NH_3$ molecules to form $Ti^+NH_2(NH_3)_4$. In this way, one can detect $^{49}Ti$ at different mass of 133, away from the spectra interference on the original mass number, 49.

In a feature, to detect the polyatomic ion $Ti^+NH_2(NH_3)_4$, Q2 is controlled based on exact mass calculated from mass number of 133. As recognized by the inventors, an error occurs if a conventional mass determination is used, namely, the exact mass in a polyatomic ion $Ti^+NH_2(NH_3)_4$ is different from the exact mass calculated from mass number of 133 by a conventional way.

Exact mass of 133 Cs=132.905452. Exact mass of $^{49}TiNH_2(NH_3)_4$=133.072785 (Exact mass of $^{49}Ti$, $^{14}N$ and $^1H$ are 48.947865, 14.003074 and 1.007825).

The mass deviation of 133 Cs is −0.094548, and that of the latter polyatomic ion is +0.072785.

There is an 0.167333 amu difference.

The difference causes problem in element analysis, namely, a low signal and/or non linear calibration.

Titanium (Ti) Isotope with Water Vapor ($H_2O$) Cell Gas

If cell gas is water $H_2O$ vapor, following is applied.

Target product ion is expressed as $T^+(H_2O)_i$ or $T^+H(H_2O)_i$, $T^+O(H_2O)_i$, or $T^+OH(H_2O)_i$: T is a target element isotope to be measured e.g. T=$^{49}Ti$ and i=0, 1,2,3

Ma: Mass number of target element isotope, Mp; Mass number of polyatomic ion containing the target isotope.

EMa; Exact mass of target element isotope, EMp; Exact mas of polyatomic ion containing the target isotope.

Num of O: Number of Oxygen atom contained in the polyatomic ion.

Num of H: Number of Hydrogen atom contained in the polyatomic ion.

EMo: exact mass of Oxygen isotope 16O atom , EMo=15.994915

EMh: exact mass of hydrogen isotope 1 H atom, EMh=1.007825 N1=INT (Mp−Ma)/18; *) INT (A) is maximum integer which doesn't exceed A.

N2=Mp−Ma−18.N1

If N1×18=Mp−Ma; Target product ion is $T^+(H_2O)N_1$, then 'Num of O·=N1, 'Num of H'=2×N1

If N2=17; Target product ion is $T^+OH(H_2O)N_1$, then 'Num of O'=N1+1, 'Num of H'=2×N1+1

If N2=16; Target product ion is $T^+O(H_2O)N_1$, then 'Num of O'=N1+1, 'Num of H'=2×N1

If Not either of above; Target product ion is $T^+H(H_2O)N_1$, then 'Num of O'=N1, Num of H=Mp−Ma−1 Bx 'Num of O'

EMp=EMa+EMo×'Num of O'+EMh×'Num of H'*)

In this case, when $H_2O$ cell gas is used; $^{49}Ti+H_{12}(H_2O)_4$ is formed. Mass number of the polyatomic ion is 133, and the exact mass determined and used is 133.084025.

Titanium (Ti) Isotope with Methane ($CH_4$) Cell Gas

If cell gas is methane $CH_4$, following is applied.

Target product ion is expressed as $T^+(CH_4)_i$; or $T^+H(CH_4)_i$, $T^+C(CH_4)_i$ or $T^+CH(CH_4)_i$ or $T^+CH_2(CH_4)_i$; or $T^+CH_3(CH_4)_i$: T is isotope to be measured e.g. T=$^{49}Ti$ and i=0, 1,2,3.

Ma: Mass number of target isotope, Mp; Mass number of polyatomic ion containing the target isotope.

EMa: Exact mass of target isotope, EMp; Exact mas of polyatomic ion containing the target isotope.

Num of C: Number of Carbon atom contained in the polyatomic ion.

Num of H: Number of Hydrogen atom contained in the polyatomic ion.

EMc: exact mass of Carbon isotope 12C atom, EMn=12.00000.

EMh: exact mass of hydrogen isotope 1 H atom, EMh=1.007825.

N1=INT (Mp−Ma)/16; *) INT (A) is maximum integer which doesn't exceed A.

N2=Mp−Ma−16*N1

If N1×16=Mp−Ma; Target product ion is $T^-(CH_4)N_1$. then 'Num of C'=N1, 'Num of H'=4×N1

If N2=12; Target product ion is $T^+C(CH_4)N_1$, then 'Num of C'=N1+1, 'Num of H'=4×N1

If N2=13; Target product ion is $T^+CH(CH_4)N_1$, then 'Num of C'=N1+1, 'Num of H'=4×N1+1

If N2=14; Target product ion is $T^+CH_2(CH_4)N_1$, then 'Num of C'=N1+1, 'Num of H'=4×N1+2

If N2=15; Target product ion is $T^+CH_3(CH_4)N_1$. then 'Num of C'=N1+1, 'Num of H'=4×N1+3.

If Not either of above; Target product ion is $T^+H(CH_4)N_1$, then 'Num of C'=N1, 'Num of H'=Mp−Ma−16×'Num of N' EMp=EMa+EMc×'Num of C'+EMh×'Num of H'.

Cesium Isotope

In one example, a target cesium isotope is measured as part of polyatomic ion. The target element isotope is $^{133}Cs$ with a mass number 133. It is measured as the atomic ion of $^{133}Cs^+$. In one example, the exact mass used herein of $^{133}Cs^+$ is 132.905452, when a target isotope is measured as a polyatomic atomic ion containing it.

Titanium Isotope

In one example, a target titanium isotope is $^{49}Ti$. It is measured as a polyatomic ion of $^{49}Ti^+NH_2(NH_3)_4$ with a mass number 133. In one example, the exact mass of $^{49}Ti^+NH_2(NH_3)_4$ in an embodiment here is 133.072785, when a target isotope is measured as a polyatomic atomic ion containing it.

Embodiments of an element analyzer system using a triple quadrupole ICP-MS (ICP-QQQ) are described in further detail below. These embodiments include an exact mass determination for a target element in a polyatomic ion that accounts for mass deviation correction.

Sample Analysis using Triple Quadrupole ICP-MS (ICP-QQQ)

Figure 5:
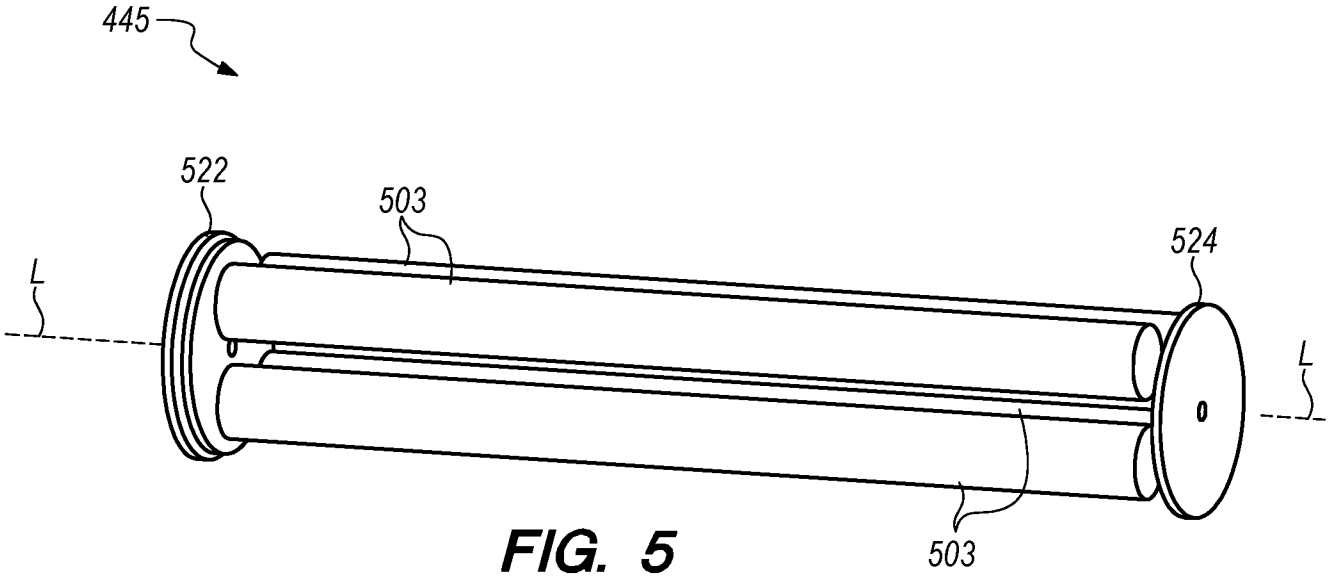
FIG. 5 is a schematic perspective view of an example ion guide according to an embodiment of the present disclosure.
Figure 6:
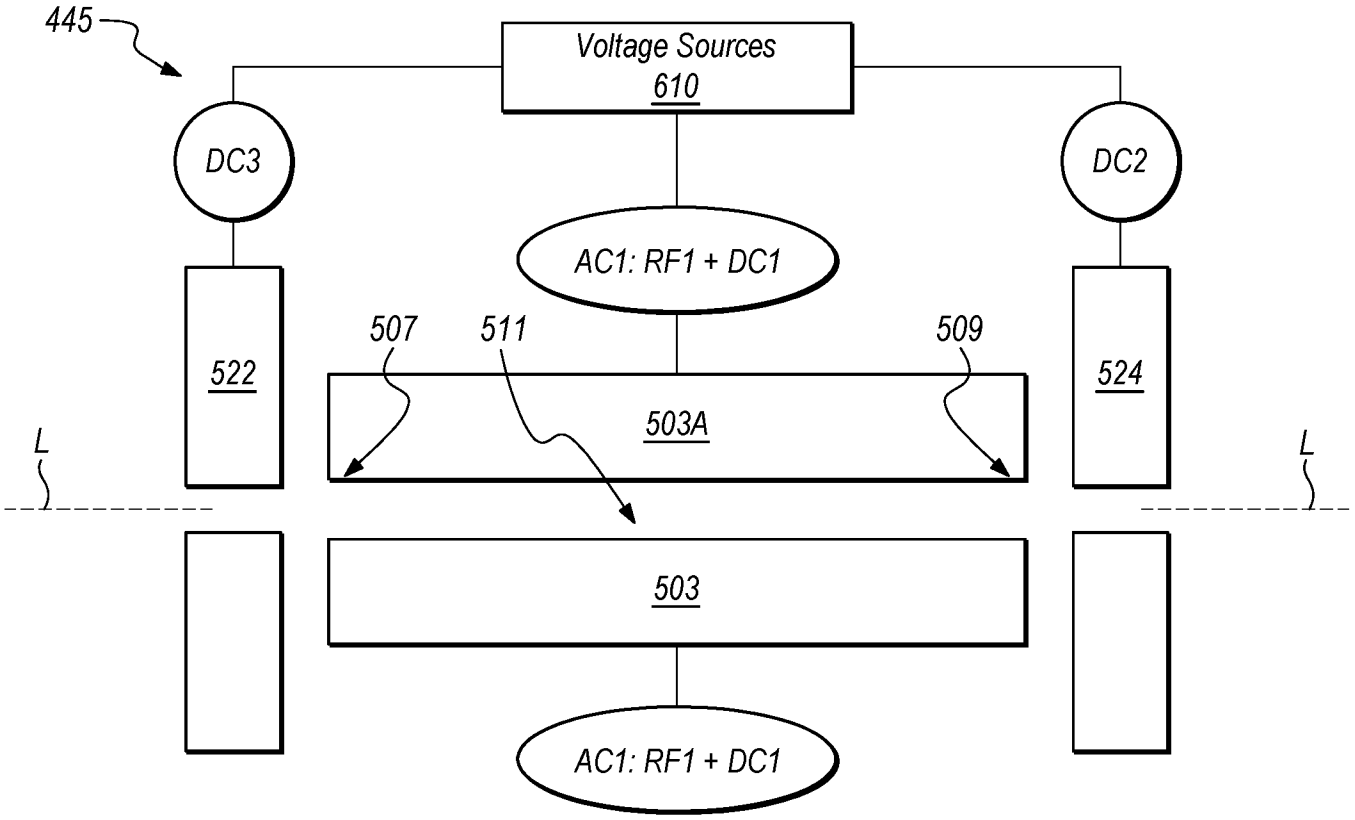
FIG. 6 is a schematic side view of an example ion guide, as shown in FIG. 5, along with voltage sources according to an embodiment of the present disclosure.

In further embodiments, an exact mass determination for polyatomic ions is carried out to filter masses in an ion beam for a sample being analyzed. Examples of sample analysis with polyatomic ion mass data determination are described with respect to an example system with a tandem ICP-QQQ 410 (FIG. 4), and rod electrodes (FIGS. 5 and 6). For brevity, the operation of the system shown in FIGS. 4-6 is further described with respect to methods for analyzing a target element (FIGS. 7-11) and examples in FIGS. 12-15.

Figure 4:
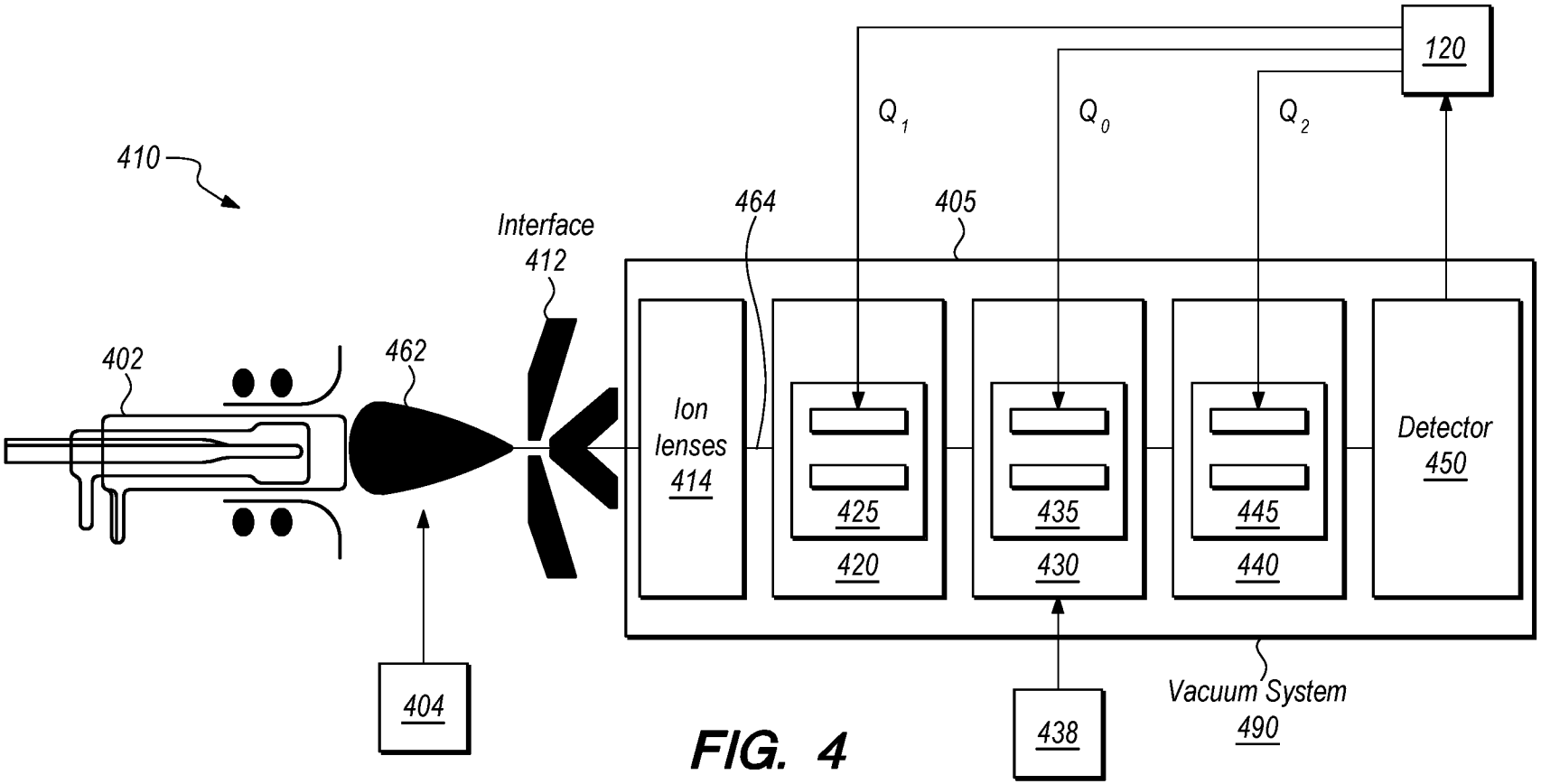
FIG. 4 is a diagram of an element analyzer system using a triple quadrupole inductively coupled plasma-mass spectrometer (ICP-QQQ) according to an embodiment of the present disclosure.

FIG. 4 a diagram of an ICP-QQQ system 410 according to an embodiment. Generally, the structures and operations of various components of ICP-MS systems including ICP-QQQ mass spectrometer systems are known to persons skilled in the art, and accordingly are described only briefly herein as necessary for understanding the subject matter being disclosed.

ICP-QQQ system 410 includes a tandem mass spectrometer 405. An ion source 402 and interface 412 can be provided to provide an input charged plasma beam into tandem mass spectrometer 405. Ion source 402 may include a plasma source for atomizing and ionizing the sample. In the illustrated embodiment, the plasma source is flow-through plasma torch such as an ICP torch. In operation, a gas source supplies a plasma-forming gas. The plasma-forming gas is typically, but not necessarily, argon. A sample may flow through a sample injector to be injected into an active plasma, as depicted by an arrow 462. As the sample flows through heating zones of an ICP torch and eventually interacts with plasma, the sample undergoes drying, vaporization, atomization, and ionization, whereby analyte ions are produced from components (particularly atoms) of the sample, according to principles appreciated by persons skilled in the art.

A sample can be introduced through a sample introduction section into the plasma beam in an area 462. For example, a sample source 404 may provide the sample to be analyzed. A pump and a nebulizer may be used for converting the sample into an aerosol. The nebulizing gas may be the same gas as the plasma-forming gas utilized to create plasma in the ion source 402, or may be a different gas. Sample source 404 may, for example, include one or more vials. A plurality of vials may contain one or more samples, various standard solutions, a tuning liquid, a calibration liquid, a rinse liquid, etc. Sample source 404 may include an automated device configured to switch between different vials, thereby enabling the selection of a particular vial for use in system 410.

In another embodiment, the sample may be a gas and not require a nebulizer. In another embodiment, sample source 404 may be or include a pressurized reservoir containing a liquid or gas sample and not require a pump. In another embodiment, sample source 404 may be the output of an analytical separation instrument such as, for example, a liquid chromatography (LC) or gas chromatography (GC) instrument. Other types of devices and means for sample introduction into ICP-MS systems are known and need not be described herein.

Interface 412 may provide a stage of pressure reduction between ion source 402, which typically operates at or around atmospheric pressure (760 Torr), and other evacuated regions of ICP-QQQ 405. Vacuum system 490 can be used to apply a vacuum to exhaust sections of tandem mass spectrometer 405. For example, vacuum system 490 may maintain desired internal pressures or vacuum levels in the internal regions, and in doing so removes neutral molecules not of analytical interest from the ICP-QQQ 405. Vacuum system 490 may include appropriate pumps and passages communicating with ports of regions to be evacuated.

Tandem mass spectrometer 405 includes first and second quadrupole mass analyzers 420, 440 arranged along a beam path 464 and on opposite sides of a collision/reactant cell 430. Collision/reaction cell 430 can be a cell with a cell gas for ion collision or ion reaction in different embodiments. Ion lenses 414 can be arranged at an input side of the tandem mass spectrometer 405 along the beam path before first quadrupole mass analyzer 420. An ion detector 450 can be arranged at an output side of the tandem mass spectrometer 405 along the beam path after second quadrupole mass analyzer 440. Ion detector 450 can be coupled to provide output signals to workstation 120.

Collision/reaction cell 430 is arranged along the beam path 464 in between first and second quadrupole mass analyzers 420, 440. A collision/reaction gas source 438 (e.g., a pressurized reservoir) may be configured to flow one or more (e.g., a mixture of) collision/reaction gases into the interior of collision/reaction cell 430. Collision/reaction cell 430 can include an ion guide 435 having quadrupole electrodes which correspond to the central "Q" in the QQQ configuration (denoted $Q_0$ in FIG. 4). In an embodiment, a power source may receive a control signal from workstation 120 and generate AC voltage signals to be applied to the quadrupole electrodes to create a desired radiofrequency (RF) field to guide the ions through cell 430. The RF field serves to focus the ion beam on path 464 along the longitudinal axis by limiting the excursions of the ions in radial directions relative to the longitudinal axis. In an embodiment, ion guide 435 in cell 430 is an RF-only device without the capability of mass filtering. In another embodiment, ion guide 435 may function as a mass filter, by superposing DC potentials on the RF potentials as appreciated by persons skilled in the art.

First and second quadrupole mass analyzers 420, 440 act to filter masses of ions traveling along the beam path 464 through tandem mass spectrometer 405. Ion guides 425 and 445 have electrodes in first quadrupole mass analyzer 420 and second mass analyzer 440 respectively. Mass analyzer 420 acts as a first (or pre-cell) quadrupole mass filter Q1. Mass analyzer 440 corresponds to a second (final) quadrupole mass filter Q2. First quadrupole mass analyzer 420 has a first quadrupole value (Q1) used to control which ions enter collision reaction cell 430. Second quadrupole mass analyzer 440 has a second quadrupole value (Q2) used to control which ions travel to the detector 450.

In an embodiment, ion guide 425 may function as a pre-cell mass filter, by superposing DC potentials on RF potentials based on exact mass for a target element as described herein. In an embodiment, ion guide 445 may also function as a post-cell mass filter, by superposing DC potentials on the RF potentials (e.g., U, Vp voltage signals) based on exact mass for a polyatomic ion having target element as described further below. In an embodiment, a power source may receive a control signal 125 from workstation 120 and generate DC and AC voltage signals (e.g., U, Vp voltage signals) to be applied to the quadrupole electrodes to create a desired RF field to guide and filter the ions through first and second quadrupole mass analyzers 420, 440.

An example ion guide is described in further detail with respect to FIGS. 5-6. FIG. 5 is a schematic perspective view of an example of an ion guide 445 in mass analyzer 440 according to an embodiment. Ion guide 445 is positioned between an entrance and exit in mass analyzer 440. An entrance lens 522 may be positioned at the entrance, and an exit lens 524 may be positioned at the exit.

Ion guide 445 includes a plurality of ion guide electrodes 503 (or "rod electrodes"). Ion guide electrodes 503 are circumferentially spaced from each other about a longitudinal axis L of ion guide 445. Each ion guide electrode 503 is positioned at a radial distance from (and orthogonal to) the longitudinal axis L and is elongated along the longitudinal axis L. Accordingly, the ion guide electrodes 503 define an ion guide entrance 507 near entrance lens 522, an ion guide exit 509 axially spaced from the ion guide entrance 507 by an axial length of the ion guide electrodes 503 and near exit lens 524, and an axially elongated ion guide interior 511 extending from the ion guide entrance 507 to the ion guide exit 509.

FIG. 5 illustrates one embodiment of ion guide 445 having a quadrupole configuration (four ion guide electrodes). In other embodiments, ion guide 445 may have a higher-order multipole configuration, for example a hexapole (six ion guide electrodes), octopole (eight ion guide electrodes), or even higher-order multipole configuration. Ion guide electrodes 503 may be cylindrical with circular cross-sections. Alternatively, in the quadrupole case the surface of the ion guide electrodes 503 facing the ion guide interior 511 may have a hyperbolic profile. As another alternative ion guide electrodes 503 may have polygonal (prismatic, e.g. square, rectangular, etc.) cross-sections.

FIG. 6 is a schematic side (lengthwise) view of the ion guide 445 illustrated in FIG. 5 with voltage sources 610. Voltage sources 610 may be utilized to apply DC and AC potentials to various components of ion guide 445. In one example, voltage sources 610 include an RF source RF superimposed on a first DC source DC1 communicating with the ion guide electrodes 503, as schematically depicted as a voltage source RF+DC1. Voltage sources 610 further include a second DC source DC2 coupled to exit lens 524, and may further include a third DC source DC3 coupled to entrance lens 522. The various RF and DC sources may be part of the same or different voltage sources and can include a power supply. Voltage sources 610 can be provided as one or more separate components as part of workstation 120 or ICP-QQQ 405, or electrically coupled between or to workstation 120 or ICP-QQQ 405.

Depending upon a particular application, ion guides 425 and 435 can be identical or similar to ion guide 445 as described above. The same or similar voltage sources 610 may be utilized to apply RF and DC potentials to ion guides 425 and 435 like ion guide 445 but tailored to set the mass filtering in mass analyzer 120 and ion flow through cell 430.

Mass analyzers 420, 440 may be any type suitable for ICP-MS. Examples of mass analyzers include, but are not limited to, multipole electrode structures (e.g., quadrupole mass filters, linear ion traps, three-dimensional Paul traps, etc.), time-of-flight (TOF) analyzers, magnetic and/or electric sector instruments, electrostatic traps (e.g. Kingdon, Knight and ORBITRAP® traps) and ion cyclotron resonance (ICR) traps (FT-ICR or FTMS, also known as Penning traps). According to an embodiment, collision/reaction cell 430 is configured to emit ions as an ion pulse or packet (as described further below), but may be utilized in conjunction with a continuous-beam (e.g., non-pulsed, non-trapping, or non-storing) mass-analyzing instrument that receives the ion pulse(s) from the collision/reaction cell 430, such as a quadrupole mass filter 440 or other multipole device configured for non-pulsed operation, a sector instrument (e.g., containing magnetic and/or electric sectors, including double-focusing instruments), etc.

Ion detector 450 may be any device configured for collecting and measuring the flux (or current) of mass-discriminated ions outputted from mass analyzer 440. Examples of ion detectors include, but are not limited to, electron multipliers, photomultipliers, micro-channel plate (MCP) detectors, image current detectors, and Faraday cups. Ion detector 450 (at least the front portion that receives the ions) can be oriented at a ninety degree angle to the ion exit of mass analyzer 440. In other embodiments, however, ion detector 450 may be on-axis with the ion exit of the mass analyzer 440.

In operation, mass analyzer 420 receives an ion beam and separates or sorts the ions on the basis of their differing mass-to-charge (m/z) ratios as a pre-cell mass filter before outputting the ion beam to collision/reaction cell 430. Mass analyzer 440 receives an ion beam from the collision/reaction cell 430 and separates or sorts the ions on the basis of their differing mass-to-charge (m/z) ratios. The separated ions pass through mass analyzer 440 and arrive at ion detector 450. The separated ions pass through mass analyzer 440 and arrive at ion detector 450. Ion detector 450 detects and counts each ion and outputs an electronic detector signal (ion measurement signal) to a data acquisition component of workstation 120 such as element analyzer 122. The mass discrimination carried out by mass analyzers 420, 440 enables the ion detector 450 to detect and count ions having a specific m/z ratio separately from ions having other m/z ratios (derived from different analyte elements of the sample), and thereby produce ion measurement signals for each ion mass (and hence each analyte element) being analyzed. Ions with different m/z ratios may be detected and counted in sequence.

Element analyzer 122 processes the signals received from ion detector 450 and generates a mass spectrum, which shows the relative signal intensities (abundances) of each ion detected. The signal intensity so measured at a given m/z ratio (and therefore a given analyte element) is directly proportional to the concentration of that element in the sample processed by ICP-QQQ 405. In this manner, the existence of chemical elements contained in the sample being analyzed can be confirmed and the concentrations of the chemical elements can be determined.

While not specifically shown in FIG. 4, the ion optical axis through ion guides and other ion optics may be offset from the ion optical axis through the entrance into the mass analyzer 440, and ion optics may be provided to steer the ion beam through the offset. By this configuration, additional neutral species are removed from the ion path 464.

Figure 11:
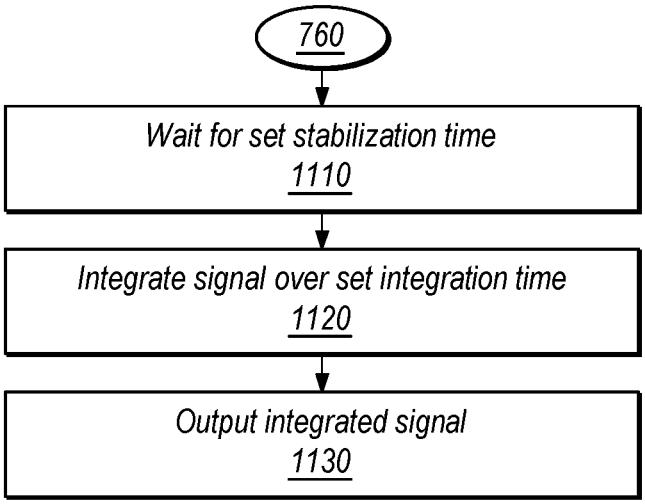
FIG. 11 is a flow diagram illustrating the generating of an output signal of FIG. 7 in further detail according to an example of the present disclosure.
Figure 12:
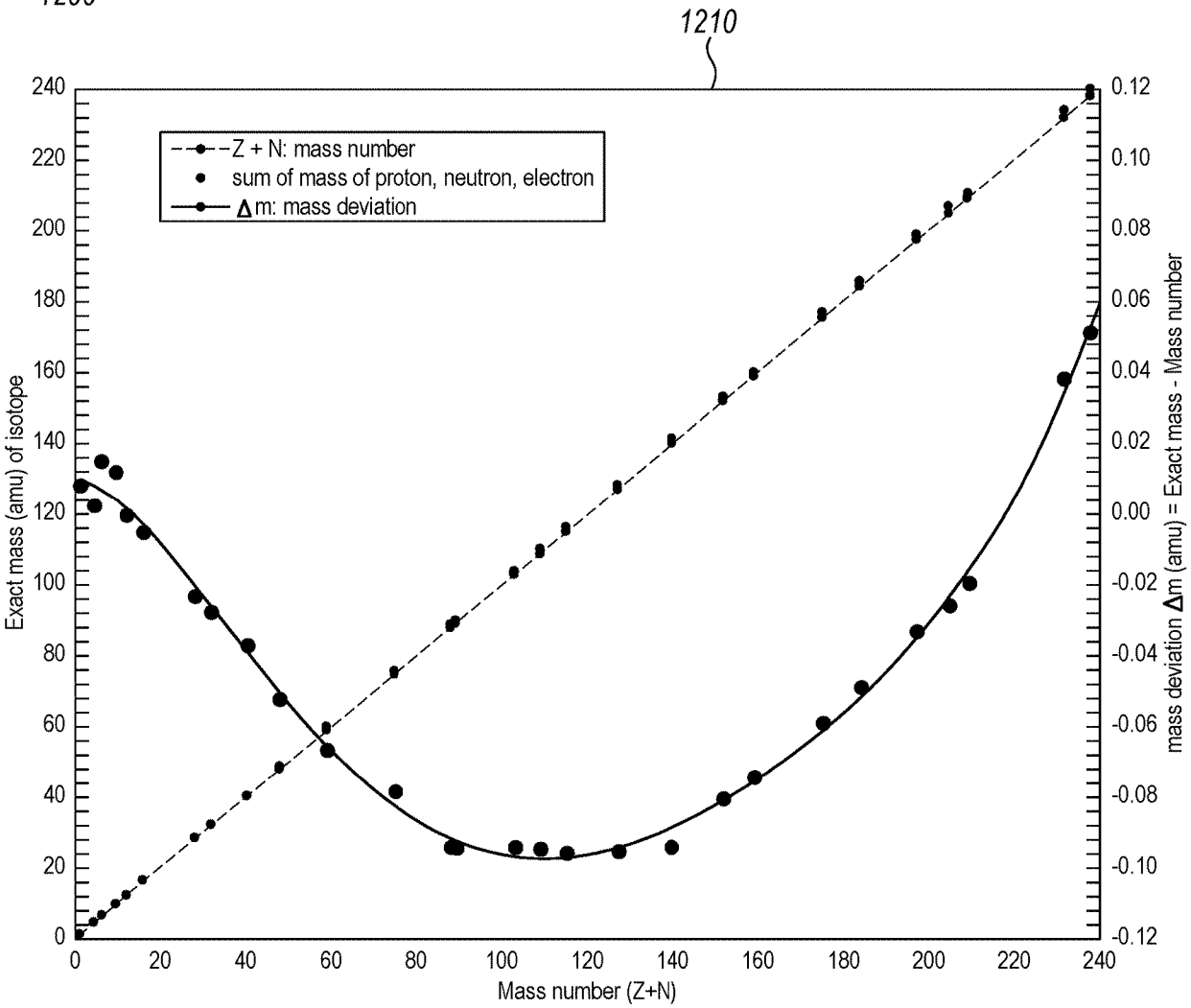
FIG. 12 shows examples of the exact mass and conventional mass deviation for different mass number isotopes in table and graph forms.
Figure 15:
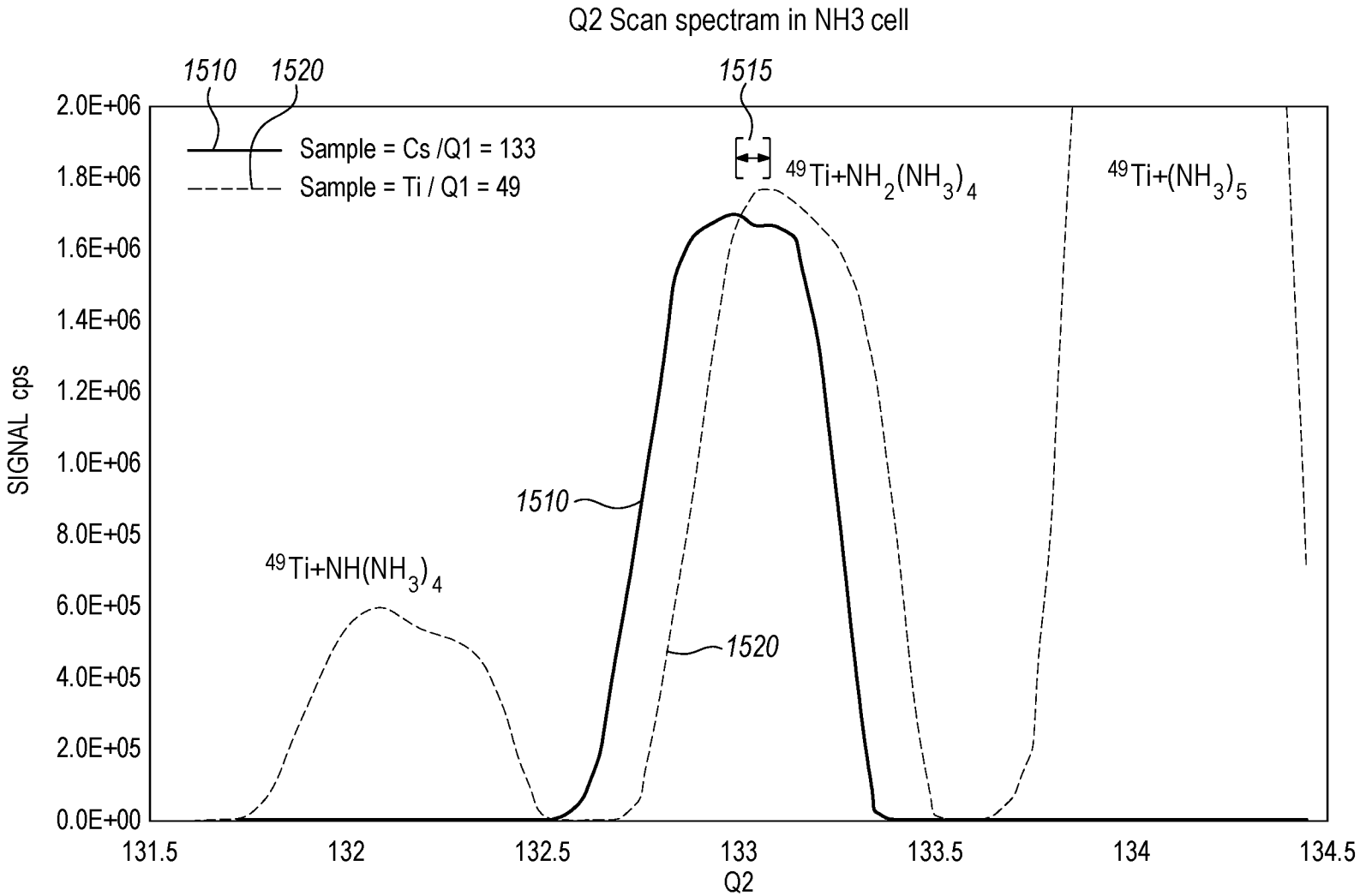
FIG. 15 illustrates an example Q2 scan mass spectrum of $^{133}Cs^{+}$ and $^{49}Ti^{+}NH_2(NH_3)_4$ in $NH_3$ cell gas mode.

The operation is further described with respect to methods for analyzing a target element (FIGS. 7-11), an example user-interface (FIG. 13), and examples of exact mass for single atomic ions and exact mass with mass deviation correction for analysis of target elements in polyatomic ions (FIGS. 12 and 14-15).

Analyzing a Target Element Isotope Included in a Polyatomic Ion using ICP-MS

Figure 7:
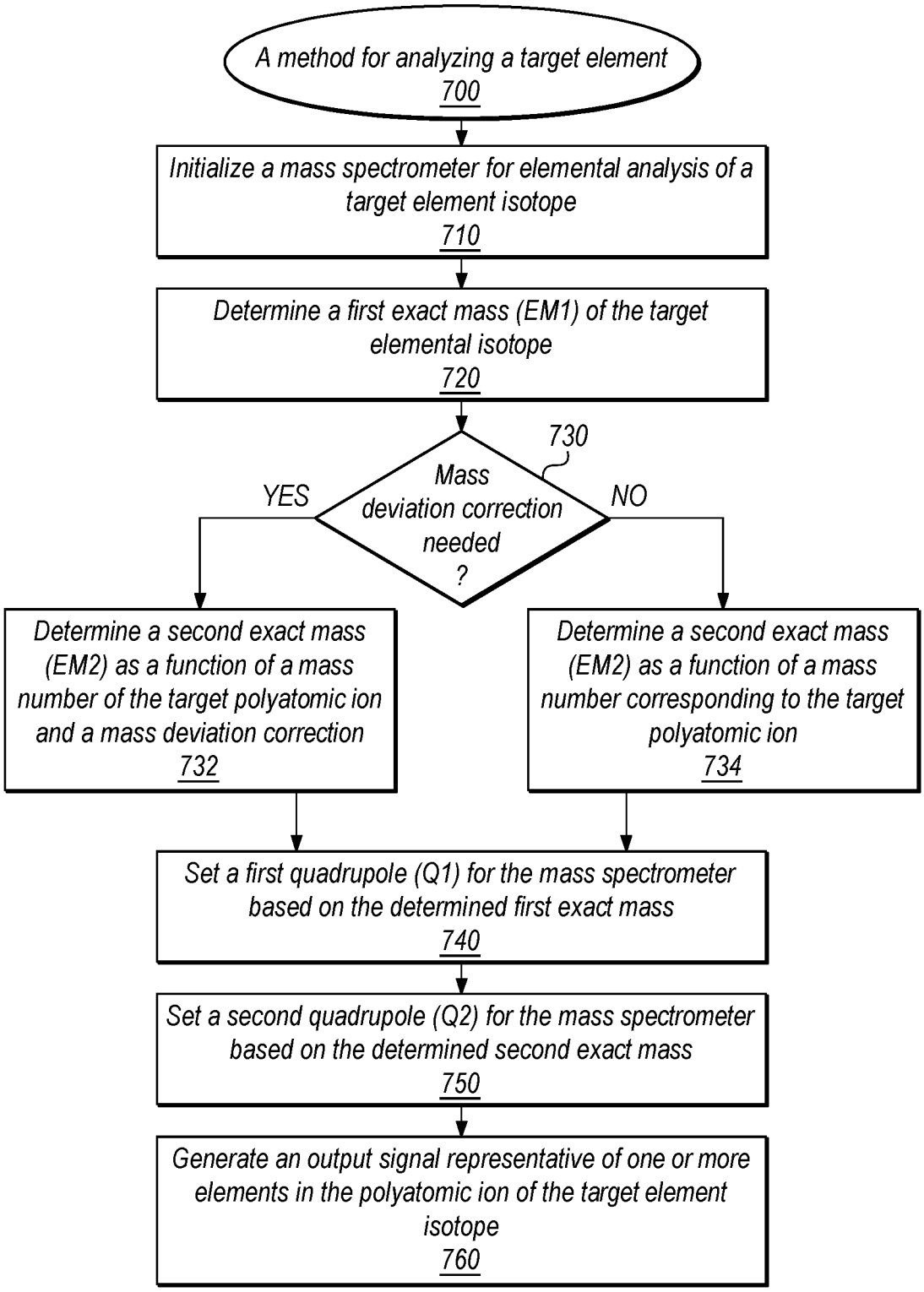
FIG. 7 is a flow diagram illustrating a method for analyzing a target element isotope included in a polyatomic ion using ICP-QQQ according to an embodiment of the present disclosure.

FIG. 7 is a flow diagram illustrating a method 700 for analyzing a target element isotope included in a polyatomic ion using ICP-MS according to an embodiment of the present disclosure (steps 710-760). For brevity, method 700 is described with respect to system 410 but is not necessarily limited to element analyzer system 410. Method 700 is also described with reference to examples of target element isotopes in polyatomic ions that are illustrative and not intended to limit the invention.

Initialization

First, a mass spectrometer for elemental analysis of the target element isotope is initialized (step 710). For example, a tandem mass spectrometer 405 including first and second quadrupole mass analyzers arranged in series along an ion path on opposite sides of a reaction cell between a plasma source 408 and an ion detector 450 is initialized.

Figure 8:
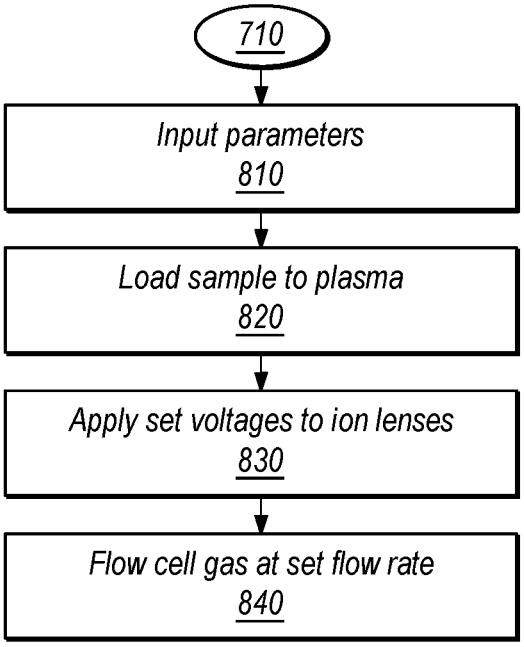
FIG. 8 is a flow diagram illustrating the initializing a mass spectrometer of FIG. 7 in further detail according to an example of the present disclosure.

FIG. 8 illustrates an example method for carrying out initializing step 710 (steps 810-840). In step 810, parameters are input into element analyzer system 410. In one embodiment, a user-interface may be used to enable a user to input parameters. According to a feature, these input parameters may include parameters that identify a target element isotope included in a polyatomic ion taking into account exact mass determined by mass deviation correction. These parameters can include identifying a mass number of a target element, selecting whether to perform a mass shift calculation, and selecting whether to perform a mass deviation correction to determine an exact mass.

Figure 13:
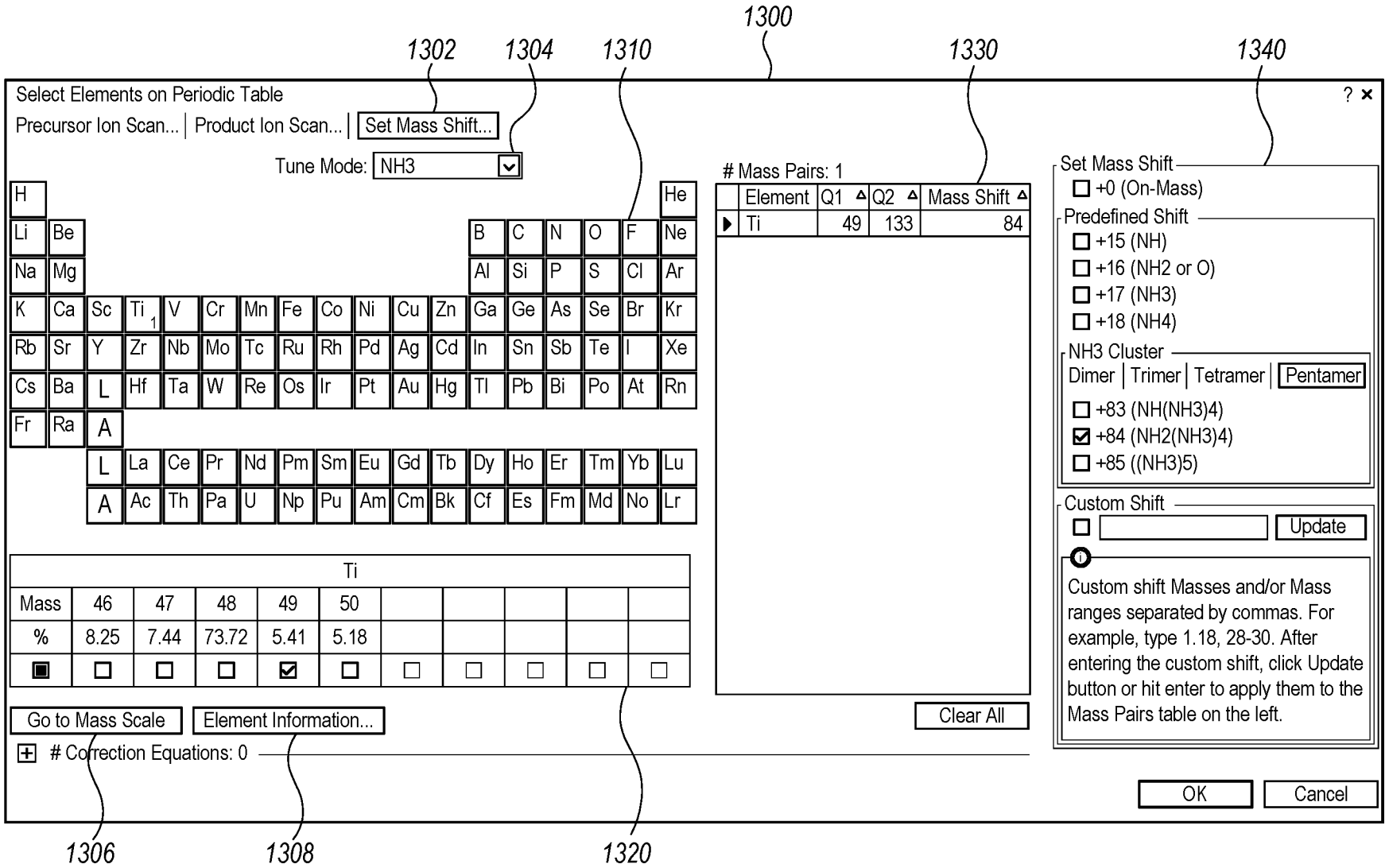
FIG. 13 is a diagram of a user-interface panel for the element analyzer system using ICP-QQQ according to an embodiment of the present disclosure.

In one example implementation shown in FIG. 13, a user-interface control panel 1300 may be displayed to a user viewing a display device. For example, consider the case where a target element is a titanium isotope ($49^+$) and it is being analyzed for its presence or absence in a polyatomic ion with an ammonium compound ($NH_2(NH_3)_4$). Controls are provided to enable a user to select a mass shift (button 1302), tune a mode (pulldown list 1304), go to a Mass Scale display (button 1306), and display Element Information (button 1308).

Control panel 1300 may include a first panel 1310 that allows a user to select a target element. As shown in FIG. 13, panel 1310 may show a diagrammatic representation of a periodic table of elements. Elements that may be available for selection (such as Ti) can be highlighted in a different color than a background color. A user may select the element Ti through a user-interface that allows selections on control panel 1300. For instance, a user may use a peripheral device (such as a mouse or trackpad) or a touchscreen (responsive to a finger or stylus) to select element Ti. Voice or other types of controls can be used as well.

A further panel 1320 may be displayed to allow further characterization of inputs relating to the selected element Ti. For example, checkboxes or other types of user-interface elements may be used to allow a user to select which isotope of Ti is desired to be analyzed as a target element isotope. In this case, a checkbox for $Ti^+$=49, with a percent abundance of the isotope of 5.41% is shown as selected.

A further panel 1330 may be displayed to show a summary of input parameters selected for Q1, Q2 values and a mass shift value. In this example, a Q1=49, and Q2=133 and mass shift of 84 is displayed. A panel 1340 may be displayed with checkboxes or other user-interface elements that allow a user to select whether to set a mass, set a predefined shift, select a type of NH3 cluster, or set a custom shift.

In the example UI of FIG. 13, one can see a user selected Tune mode $NH_3$. A user can also set Mass pair; Q1=49 and Q2 of 133. Element analyzer 122 in response measures target elements (analytes) as polyatomic ion of $NH_3$ (ammonia cluster ion) containing $^{49}Ti^+$ and having mass number of 133. Then a new mass deviation correction will be applied to calculate the exact mass of Q2 as described herein. When Go to Mass Scale button 1306 is selected, a user can select mass number of interest in place of selecting an element in panel 1310. Element information button 1308 provides potential spectra interference on a isotope of interest, e.g. for $^{49}Ti$, potential interference of $^{32}S^{17}O$, $^{48}CaH$ etc. are shown. This can help a user to select an isotope to be measured.

For example, to set a mass shift, like when a customer wishes to set Q1=49, Q2=133 there are three ways:

1 Direct enter; user directly enter 49 for Q1 and 133 for Q2.

2 use "set mass shift" ; user enter 49 for Q1 and select predefined shift for Q2.

If $M^+NH_4$ and $+83(NH(NH_3)_4)$ are target polyatomic ions, check +18 ($NH_4$) and $+83(NH(NH_3)_4)$.

If Q2=Q1+200, user also use customer shift to check it and enter 200.

In step 820, a sample is loaded for introduction in plasma emitted from the plasma source along the ion path to form a charged ion flow. A sample can be in liquid, solid or gas form. The sample can vary depending upon a particular application. In environmental testing, for example, a sample can be drawn from soil, atmosphere, a water source, or other material being tested. For example, in the case of a titanium isotope ($^{49}Ti^+$), the sample loaded might be a soil sample.

In step 830, set voltages are applied to one or more ion lenses that focus the charged ion flow along the ion path through the mass spectrometer. Applying such voltages are well-known and would be readily apparent to a person skilled in the art given this description how to set voltages applied to ion lenses 414 to focus the charged ion flow along the ion path 464 the tandem mass spectrometer 405.

Similarly, in step 840, a flow cell gas is applied at a set flow rate as a reactant in the reaction cell 430. Applying a flow cell gas is well-known depending upon an application and it would be readily apparent to a person skilled in the art given this description how to apply to a flow cell gas at a gas rate to serve as a reactant in reaction cell 430. For example, in the case of a titantium isotope ($^{49}Ti^+$), the flow cell gas maybe an ammonia compound applied at a flow rate.

First Exact Mass (EM1) Determination

In step 720, a first exact mass (EM1) of the target elemental isotope is determined as a function of a mass number corresponding to the target elemental isotope and a first mass deviation (also called a mass shift) corresponding to the target elemental isotope. Determining the first exact mass (EM1) is well-known and conventional methods to determine EM1 can be used as would be apparent to a person skilled in the art given this description. For example, in the case of a target element isotope ($Ti^+$) an exact mass can be determined equal to a mass number (49) corresponding to the target elemental isotope ($Ti^+$) and a first mass deviation corresponding to the target elemental isotope ($Ti^+$). This determination of EM1 can be carried out by mass filter controller 124 automatically based on a look up in a table of target element isotope values and first mass deviation values (also called mass shift values) stored in a memory or directly by a calculation from similar values provided in a graph or plot. For example, a look up of an entry 330 in table 320 in FIG. 3B can be performed. Any conventional technique for determining an exact mass of EM1 of the target elemental isotope in a single atom or ion can be used. FIG. 12 shows examples of the exact mass and mass deviation for different mass number isotopes in table and graph forms. These exact mass and mass deviations are for a target isotope in a single atom or ion.

Second Exact Mass (EM2) Determination with Mass Deviation Correction

As described earlier, according to one feature, the inventors have discovered a new mass deviation correction that can be used in a second exact mass determination. The inventors found this new mass deviation correction is beneficial when a target element isotope is being analyzed in a polyatomic ion. This is further helpful where errors arise using conventional mass shift techniques. The inventors found these errors arise in tandem mass spectrometers using triple quadrupoles (ICP-QQQ) where spectral loss is often sought be to avoided by setting Q2 not equal to Q1.

In step 730, an evaluation is made to determine whether a mass deviation correction needed. In one embodiment, mass filter controller 124 evaluates whether a mass deviation correction is needed for the elemental analysis of the target element isotope included in the polyatomic ion. In one embodiment, this evaluation involves comparing whether a Q2 value is equal to (or not equal to) a Q1 value. For example, mass deviation correction is needed when Q2 does not equal Q1.

When mass deviation correction is needed, control passes to step 732 to determine a second exact mass (EM2) for the target elemental isotope in the polyatomic ion. According to an embodiment, second exact mass (EM2) is determined as a function of a mass number corresponding to the target polyatomic ion and a mass deviation correction corresponding to a reactant in the reaction cell. For example, when Q2 does not equal Q1, then EM2 of the target elemental isotope is determined as the sum of the mass number corresponding to the target polyatomic ion and a mass deviation correction corresponding to a reactant in the reaction cell. In the case of a target element isotope ($Ti^+$) and a reactant gas $NH_3$ in the reaction cell, Q2=133 and Q1=49 (Q2 not equal Q1). The second exact mass is then determined to be equal to a mass number (133) corresponding to the target polyatomic ion and a mass deviation correction corresponding to a reactant in the reaction cell. This determination of EM2 can be carried out by mass filter controller 124 automatically based on a look up in a table of target element isotope values and mass deviation correction values stored in a memory or directly by a calculation from similar values provided in a graph or plot. For example, a look up of an entry 310 in table 300 in FIG. 3A can be performed.

When mass deviation correction is not needed (i.e., Q2=Q1), control passes to step 734 to determine a second exact mass (EM2) for the target elemental isotope. According to an embodiment, second exact mass (EM2) is determined as a function of a mass number corresponding to the target ion. For example, when Q2 equals Q1, then EM2 of the target elemental isotope is determined as the sum of the mass number 133 corresponding to the target ion and a conventional mass deviation for cesium. (Cesium is the single atomic element with a mass number 133 for which conventional mass deviation data to obtain exact mass of the single atomic element is available.) This determination of EM2 can be carried out by mass filter controller 124 automatically based on a look up in a table of target element values and mass deviation values stored in a memory or directly by a calculation from similar values provided in a graph or plot as shown in FIG. 12.

Example EM1 and EM2 Determinations

In one example, the target element isotope comprises titanium (Ti) having a mass number 49, included in the polyatomic ion $Ti+NH_2(NH_3)_4$ having a mass number 133, and the reactant in the reactant cell comprises $NH_3$ cell gas. In step 720, first exact mass (EM1) is a first exact mass (EM1) having a value equal to about 48.947865. When mass deviation correction is needed, the second exact mass (EM2) obtained is second exact mass (EM2) having a value equal to about 133.072785 (step 732, row 310) When mass deviation correction is not needed, determining the second exact mass (EM2) obtains a second exact mass (EM2) having a value equal to about 132.905452 (step 734, row 330).

Setting First and Second Quadrupoles (Q1, Q2)

Figure 9:
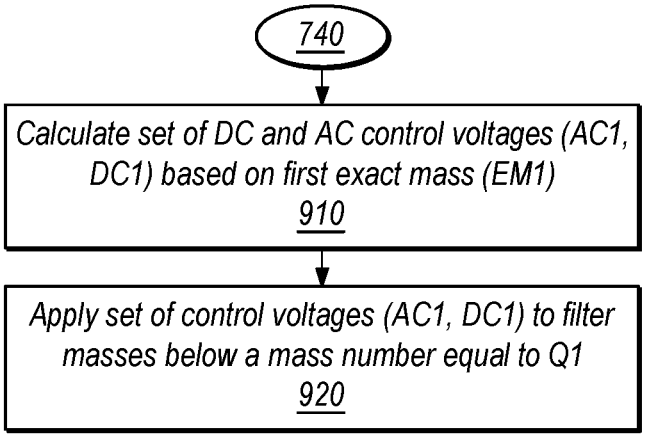
FIG. 9 is a flow diagram illustrating the setting of first quadrupole (Q1) of FIG. 7 in further detail according to an example of the present disclosure.
Figure 10:
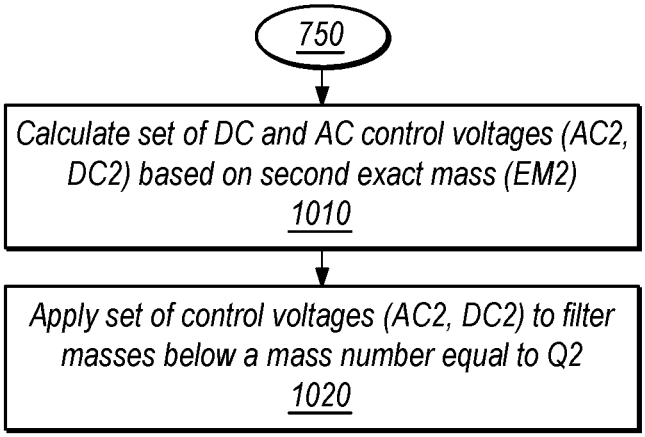
FIG. 10 is a flow diagram illustrating the setting of second quadrupole (Q2) of FIG. 7 in further detail according to an example of the present disclosure.

In step 740, a first quadrupole (Q1) is set for the mass spectrometer based on the determined first exact mass (EM1) from step 720. This setting can include applying a control voltage to filter masses below a mass number equal to Q1. FIG. 9 shows an example implementation for step 740 in further detail. First, a set of DC and AC control voltages (AC1, DC1) are calculated based on the determined first exact mass (EM1) (step 910). Then applying the set of determined DC and AC control voltages (AC1, DC1) to filter masses below a mass number equal to Q1 (step 920).

In step 750, a second quadrupole (Q2) is set for the mass spectrometer based on the determined second exact mass (EM2) from step 732 or step 734. This setting can include applying a control voltage to filter masses below a mass number equal to Q2. In a further example shown in FIG. 10, step 750 can involve calculating a set of DC and AC control voltages (AC2, DC2) based on the determined second exact mass (EM2) (step 1010). Then applying the set of determined DC and AC control voltages (AC2, DC2) to filter masses below a mass number equal to Q2 (step 1020).

Steps 740 and 750 can be carried out in workstation 120. In one embodiment, mass filter controller 124 can perform the calculating in steps 910 and 1010 and output control signals to voltage sources 610. Voltage sources 610 can then perform steps 920 and 1020 and apply respective control voltages to quadrupole mass analyzers 420 and 440.

In an embodiment, voltage control signals are voltage signals having an applied DC (U) and AC amplitude (Vp). Actual voltages U and Vp are calculated similar to well-known quadrupole mass filter controls but using exact masses of ions (EM1 and EM2) as described herein. For example, voltages U and Vp can be calculated based on the following equation (2):

$$a=8eU/(mr^2f^2),\ q=4eVp/(mr^2f^2) \quad (2),$$

where a, q are normalized parameters of a Mathieu equation, f: frequency of AC, U: applied DC voltage, V: applied AC amplitude, m: exact mass of ion (EM1 or EM2 above), and r: effective radius between electrodes of a quadrupole.

The mass resolution (Δm) of a quadrupole mass filter is determined by "a" and "q". In one example, about a=0.237, q=0.706 is used for Δm=1 amu.

For ease of use, a user may input a mass number through UI 140 to select a target element isotope. Mass filter controller 124 though can calculate actual voltages, U and Vp, applied to Q pole filter, using exact masses of ions (EM1 or EM2). For example, to calculate the exact mass (EM2) from an input mass number, mass filter controller 124 can:

when $^{49}Ti$ is measured as $Ti^+NH_2(NH_3)_4$, and a mass number of a target polyatomic ion to be 49+14×5+1×14=133, determine an exact mass (EM2) equal to 133.072785 (step 732), which is used to calculate and apply voltages U and Vp for the $2^{nd}$ quadrupole Q2 (steps 1010 and 1020).

DC and AC voltages can be applied to electrodes in a variety of ways according to desired ion flow and filtering through cell 430 and mass analyzers 420, 440 as would be apparent to a person skilled in the art given this description. In addition to calculating voltages (U, Vp) based on exact masses of ions to improve sensitivity as described herein, other techniques can be used to control an electric field and ion flow.

In one embodiment, a first DC source DC1 applies a negative DC bias potential to ion guide electrodes 503 that is constant along their length. In another embodiment, the first DC source DC1 may be configured to generate an axial DC potential gradient along the length of the ion guide electrodes 503. For this purpose, the first DC source may supply two different DC potentials which may be coupled to the entrance and exit ends of the ion guide electrodes 503, respectively. For example, the DC potentials may be coupled to electrically conductive or resistive layers of ion guide electrodes 503 at the entrance and exit ends. Application of an axial DC potential gradient may be useful to keep ions moving in the forward direction and prevent ions from escaping the ion guide 546 through entrance lens 522. Further, a second DC source DC2 may apply an exit DC potential to the exit lens 524. In addition to or alternatively to the axial DC potential gradient, after transmitting ions into ion guide 536 for a desired amount of time, a DC potential DC3 applied to entrance lens 522 may be increased to prevent ions from escaping ion guide 536 through the cell entrance lens 522 and prevent additional ions from being transferred into ion guide 536 from ion source 108.

Output Signal Generating

In step 760, system 100 (element analyzer 122) generates an output signal representative of one or more elements in the polyatomic ion of the target element isotope. As shown in FIG. 11, in one embodiment, step 760 can include the following steps (1110-1130). These steps can be carried out under the control of element analyzer 122 coupled to ion detector 150.

First, element analyzer 122 waits for a set integration time (step 1110). This set integration time can be a predetermined time that can vary depending upon the target element being analyzed, the strength or intensity of ion flow upon detector 450 or other design considerations. During this time, element analyzer 122 integrates a detection signal output by detector 450 to obtain an integration signal (step 1120). The integration signal can then be output (step 1130). Element analyzer 122 can output the integrated signal as an output signal for storage in memory, transmission to a remote site, or for display.

An advantage is more accurate measurement of target elemental atom or ion in a method where those ions are detected as polyatomic ions containing them.

The titanium and ammonia cell gas example is illustrative and not intended to be limiting. In another example, water vapor cell gas is used. The target element isotope comprises titanium (Ti) having a mass number 49, included in the polyatomic ion $Ti^{+}H^{12}(H_2O)_4$ having a mass number 133, and the reactant in the reactant cell comprises $H_2O$ cell gas. In step 720, the first exact mass (EM1) is first exact mass (EM1) having a value equal to about 48.947865. When mass deviation correction is needed, the second exact mass (EM2) obtained is second exact mass (EM2) having a value equal to about 133.084025 (step 732). When mass deviation correction is not needed, determining the second exact mass (EM2) obtains a second exact mass (EM2) having a value equal to about 132.905432 (conventional mass deviation value).

In examples, mass deviation correction values for exact mass determination for any or all of these number of different target isotopes in a number of different polyatomic ions according to different cell gases can be stored in a table or memory for look up or access by mass filter controller 124. Alternatively, values of exact masses which take into account mass deviation correction for any or all of these number of different target isotopes in a number of different polyatomic ions according to different cell gases can be stored in a table or memory for look up or access by a system controller. In still further examples, mass deviation correction values for exact mass determination (or values of exact masses which take into account mass deviation correction) can calculated directly by mass filter controller 124.

In embodiments, an elemental analyzer using MS (Quadrupole MS, TOF MS, Sector Field MS and so on) can use the exact mass determined as described herein to control operation of the MS. For example, mass filter controller 124 can control the MS (by amplitude or frequency of RF, strength of magnetic field, or time of data acquisition) based on exact mass of a target ion in a polyatomic ion. Mass filter controller 124 can use a different calculation or conversion table to get an exact mass from the mass number of the target ion when it is in a polyatomic ion containing the elemental isotope to be measured. The exact mass is different than the exact mass of the target ion when it is evaluated as a single atomic ion.

In further embodiments, an elemental analyzer using ICP-MS having quadrupoles (ICP-QQQ) can use the exact mass determined as described herein to control operation of the ICP-QQQ. In one embodiment, mass filter controller 124 can control a second quadrupole (Q2) in the ICP-QQQ based on exact mass of a target ion in a polyatomic ion when the ICP-QQQ is set to carry out a mass shift (e.g., Q2 not equal to Q1). To set the second quadrupole, the system controller can control the MS (by amplitude or frequency of RF, strength of magnetic field, or time of data acquisition) based on a determined exact mass of a target ion in a polyatomic ion. Mass filter controller 124 can use a different calculation or conversion table to get exact mass from the mass number of the target ion, when Q1 is not equal to Q2 compared to when Q2=Q1 (Q1 and Q2 are based on mass numbers set on the MS before and after a reactant cell. Mass filter controller 124 can use a different calculation or conversion table to get an exact mass from the mass number of the target ion when it is in a polyatomic ion containing the elemental isotope to be measured. The exact mass is different than the exact mass of the target ion when it is evaluated as a single atomic ion.

FIG. 15 illustrates an example Q2 scan mass spectrum of 133Cs+ and $^{49}Ti^{+}NH_2(NH_3)_4$ in $NH_3$ cell gas mode. FIG. 15 shows the difference of exact mass between 133Cs and the polyatomic ion. In one test an ICP MS instrument, Agilent 8900 ICP-MS/MS system available from Agilent Technologies, Inc. was operated based on exact mass of atom, so 133Cs was measured exactly at mass of 133, but the $^{1}Ti$ $NH_2(NH_3)_4$ was NOT. As can be seen in FIG. 15, the overlay of the 133Cs and the $^{49}Ti$ polyatomic spectrum (1510, 1520) illustrates the mass deviation under the conventional method as the nominal mass for 133Cs would be sought under the conventional calculation, where the true peak maxima is shown to deviate for the Ti polyatomic ion. The difference in true peak maxima is shown at 1515. This difference is an example of the mass deviation corrected as described by the inventors herein.

Example Computing System

In an embodiment, workstation 120 (including element analyzer 122 and mass filter controller 124) can include one or more processors (typically electronics-based), which may be representative of a main electronic processor providing overall control (e.g., a system controller), and one or more electronic processors configured for dedicated control operations or specific signal processing tasks (e.g., a graphics processing unit or GPU, a digital signal processor or DSP, an application-specific integrated circuit or ASIC, a field-programmable gate array or FPGA, etc.). Workstation 120 may also include one or more memories (volatile and/or non-volatile) (including but not limited to memory 130) for storing data and/or software. Workstation 120 may also include one or more device drivers for controlling one or more types of user interface devices (such as UI 140) and providing an interface between the user interface devices and components of workstation 120 communicating with the user interface devices. Such user interface devices may include user input devices (e.g., keyboard, keypad, touch screen, mouse, joystick, trackball, and the like) and user output devices (e.g., display screen, printer, visual indicators or alerts, audible indicators or alerts, and the like). In various embodiments, workstation 120 may be considered as including one or more of the user input devices and/or user output devices, or at least as communicating with them.

Workstation 120 may also include one or more types of computer programs or software contained in memory and/or on one or more types of computer-readable media. The computer programs or software may contain non-transitory instructions (e.g., logic instructions) for controlling or performing various operations of the ICP-MS systems 100 and 410. The computer programs or software may include application software and system software. System software may include an operating system (e.g., a Microsoft Windows® or Apple iOS® operating system) for controlling and managing various functions of workstation 120, including interaction between hardware and application software. In particular, the operating system may provide a graphical user interface (GUI) displayable via a user output device, and with which a user may interact with the use of a user input device. Workstation 120 may also include one or more data acquisition/signal conditioning components (DAQs) (as may be embodied in hardware, firmware and/or software) for receiving and processing ion measurement signals outputted by ion detector 450, including formatting data for presentation in graphical form by the GUI.

Workstation 120 (including mass filter controller 124) may further include a cell controller (or control module) configured to control the operation of the collision/reaction cell 430 and coordinate and/or synchronize the cell operation with the operations of the ion source 402, the ion optics 414, and any other ion processing devices provided in the ICP-MS systems 100 and 410. This control operation for cell 430 and other components may be provided in addition to the mass filter control described above for mass analyzers 420, 440.

It will be understood that FIG. 1 is high-level schematic depiction of an example of a workstation 120 consistent with the present disclosure. Other components, such as additional structures, devices, electronics, and computer-related or electronic processor-related components may be included as needed for practical implementations. It will also be understood that workstation 120 is schematically represented as functional blocks intended to represent structures (e.g., circuitries, mechanisms, hardware, firmware, software, etc.) that may be provided. The various functional blocks and any signal links between them have been arbitrarily located for purposes of illustration only and are not limiting in any manner. Persons skilled in the art will appreciate that, in practice, the functions of workstation 120 may be implemented in a variety of ways and not necessarily in the exact manner illustrated in FIG. 1 and described by example herein.

Example embodiments are described herein in the context of an element analyzer system and methods. These include a workstation 120 having control logic for exact mass determination as described herein that can be implemented in software, firmware, hardware or any combination thereof. The foregoing description is illustrative only and is not intended to be in any way limiting. Other embodiments will readily suggest themselves to those of ordinary skill in the art having the benefit of this disclosure.

Further Embodiments

1. A method for controlling mass filtering of polyatomic ions in an ion beam passing through an inductively coupled plasma mass spectrometer (ICP-MS) comprising: determining polyatomic ion mass data representative of the exact mass of a polyatomic ion having a target isotope; generating a first control signal based on the determined polyatomic ion mass data; and outputting the first control signal to an ICP-MS to filter based on mass the polyatomic ions in the ion beam traveling through the ICP-MS to an ion detector.

2. The method of claim 1, wherein the polyatomic ion mass data comprises the exact mass of the polyatomic ion having the target isotope.

3. The method according to any one of claim 1 or 2, further comprising storing mass data in memory including storing the polyatomic ion mass data.

4. The method according to any one of claims 1-3, wherein the determining comprises accessing the polyatomic ion mass data stored in memory.

5. The method according to any one of claims 1-4, wherein the determining comprises calculating the exact mass of the polyatomic ion having the target isotope.

6. The method according to any one of claims 1-4, wherein the determining comprises performing a table look up to determine the exact mass of the polyatomic ion having the target isotope.

7. The method according to any one of claims 1-6, further comprising storing mass deviation correction data in memory, wherein the mass deviation correction data is based on a target isotope and a cell gas.

8. The method of claim according to any one of claims 1-7, wherein the ICP-MS comprises a triple quadrupole ICP-MS having first and second mass analyzers controlled to filter ion masses, and the first control signal is output to the second mass analyzer to control one or more voltage signals applied to the second mass analyzer.

9. The method of claim 8, wherein the one or more voltage signals comprise a DC voltage signal (U) and an AC voltage signal (Vp) and further comprising applying the U and Vp voltages to quadrupole electrodes in the second mass analyzer to control mass filtering of the ion beam passing through the second mass analyzer.

10. The method according to any one of claims 1-7, wherein the ICP-MS comprises a single quadrupole ICP-MS having a mass analyzer, and the first control signal is output to the mass analyzer to control mass filtering of the ion beam passing through the mass analyzer.

11. The method according to any one of claims 1-7, further comprising detecting the polyatomic ions having a target isotope incident on the ion detector to obtain raw data, pre-processing and outputting the pre-processed data representative of the detected polyatomic ions for analysis and display to a user.

12. A non-transitory computer-readable storage device having instructions stored thereon that, when executed by at least one processor, causes the at least one processor to perform operations for controlling mass filtering of polyatomic ions in an ion beam passing through an inductively coupled plasma mass spectrometer (ICP-MS), wherein the operations comprise: determining polyatomic ion mass data representative of the exact mass of a polyatomic ion having a target isotope; generating a first control signal based on the determined polyatomic ion mass data; and outputting the first control signal to the ICP-MS to filter based on mass the polyatomic ions in the ion beam traveling through the ICP-MS.

13. An element analyzer system configurable for use in an inductively coupled plasma mass spectrometer (ICP-MS), comprising: a user-interface that enables a user to input selections for analyzing a target isotope included in a polyatomic ion; and one or more processors coupled to the user-interface and configured to received data representative of the input selections and further configured to: determine polyatomic ion mass data representative of the exact mass of a polyatomic ion having a target isotope; generate a first control signal based on the determined polyatomic ion mass data; and initiate output of the first control signal to an ICP-MS to filter based on mass the polyatomic ions in the ion beam traveling through the ICP-MS.

14. The system of claim 13, wherein the polyatomic ion mass data comprises the exact mass of the polyatomic ion having the target isotope.

15. The system according to any one of claims 13 and 14, further comprising a memory that stores mass data including the polyatomic ion mass data.

16. The system of claim 15, wherein the one or more processors are configured to access the polyatomic ion mass data stored in the memory.

17. The system according to any one of claims 13-16, wherein the one or more processors are configured to calculate the exact mass of the polyatomic ion having the target isotope.

18. The system according to any one of claims 13-16, wherein the one or more processors are further configured to perform a table look up to determine the exact mass of the polyatomic ion having the target isotope.

19. The system according to any one of claims 13-18, wherein the one or more processors are further configured to store mass deviation correction data in memory, wherein the mass deviation correction data is based on a target isotope and a cell gas used in the ICP-MS to form the polyatomic ions in the ion beam.

20. The system according to any one of claims 13-19, wherein the ICP-MS comprises a triple quadrupole ICP-MS having first and second mass analyzers controlled to filter ion masses, and wherein the one or more processors are configured to output the first control signal to the second mass analyzer to control one or more voltage signals applied to the second mass analyzer.

21. The system of claim 20, further comprising a power supply coupled to the second mass analyzer, wherein the power supply generates the one or more voltage signals applied to the second mass analyzer, and wherein the one or more voltage signals comprise a DC voltage signal (U) and an AC voltage signal (Vp) and further comprising applying the U and Vp voltages to quadrupole electrodes in the second mass analyzer to control mass filtering of the ion beam passing through the second mass analyzer.

22. The system according to any one of claims 13-19, wherein the ICP-MS comprises a single quadrupole ICP-MS having a mass analyzer, and the first control signal is output to the mass analyzer to control mass filtering of the ion beam passing through the mass analyzer.

23. The system according to any one of claims 13-22, wherein ICP-MS includes an ion detector that detects the polyatomic ions having a target isotope incident on the ion detector to obtain raw data, and outputs the pre-processed data representative of the detected polyatomic ions for analysis and display to a user.

24. A method for analyzing a target element isotope included in a polyatomic ion, comprising: initializing a mass spectrometer for elemental analysis of the target element isotope, the mass spectrometer including a plasma source, first and second quadrupole mass analyzers arranged in series along an ion path on opposite sides of a reaction cell, and a detector; determining a first exact mass (EM1) of the target element isotope; evaluating whether a mass deviation correction is needed for the elemental analysis of the target element isotope included in the polyatomic ion; when mass deviation correction is needed, determining a second exact mass (EM2) of the target element isotope as present in the polyatomic ion; setting the first quadrupole (Q1) mass analyzer based on the determined first exact mass; setting the second quadrupole (Q2) mass analyzer based on the determined second exact mass; and generating an output signal representative of detected polyatomic ions having the target element isotope.

25. The method of claim 24, wherein the determining EM1 of the target element isotope comprises determining EM1 as a function of a mass number corresponding to the target elemental isotope in a single atomic ion; and, when mass deviation correction is needed, the determining EM2 comprises determining EM2 as a function of a mass number corresponding to the target polyatomic ion and a mass deviation correction corresponding to a reactant in the reaction cell.

26. The method of claim 24, wherein the determining the first exact mass (EM1) of the target elemental isotope comprises determining a first exact mass (EM1) value equal to a function of a mass number corresponding to the target elemental isotope and a first mass deviation corresponding to the target elemental isotope; and wherein the determining a second exact mass (EM2) of the target elemental isotope comprises determining the second exact mass (EM2) value equal to a function of a mass number corresponding to the target polyatomic ion and a mass deviation correction corresponding to a reactant in the reaction cell.

27. The method of claim 24, wherein each determining of the first and second exact masses (EM1, EM2) comprises accessing the respective first and second exact masses from stored mass data in memory or calculating the respective first and second exact masses.

28. The method of claim 24, wherein the target element isotope comprises titanium (Ti) having a mass number 49, included in the polyatomic ion $Ti+NH_2(NH_3)_4$ having a mass number 133, and the reactant in the reactant cell comprises $NH_3$ cell gas.

29. The method of claim 24, wherein the target element isotope comprises titanium (Ti) having a mass number 49, included in the polyatomic ion $Ti+H_{12}(H_2O)_4$ having a mass number 133, and the reactant in the reactant cell comprises $H_2O$ cell gas.

30. The method according to any one of claims 24-29, wherein the initializing the mass spectrometer comprises: enabling a user to input parameters through a user-interface; loading a sample for introduction in plasma emitted from the plasma source along the ion path to form a charged ion flow; applying set voltages to one or more ion lenses that focus the charged ion flow along the ion path the mass spectrometer; and applying a flow cell gas at a set flow rate as a reactant in the reaction cell.

31. The method according to any one of claims 24-30, wherein the setting the first quadrupole (Q1) for the mass spectrometer based on the determined first exact mass comprises applying a control voltage to filter masses below a mass number.

32. The method according to any one of claims 24-31, wherein the setting the second quadrupole (Q2) for the mass spectrometer based on the determined second exact mass comprises applying a control voltage to filter masses below a mass number.

33. An element analyzer system comprising: an inductively coupled plasma mass spectrometer; a workstation coupled to the inductively coupled plasma mass spectrometer, wherein the workstation includes: an user-interface that enables a user to input selections for analyzing a target element isotope included in a polyatomic ion; and one or more processors coupled to the user-interface and configured to received data representative of the input selections and to perform the following operations: determining a first exact mass (EM1) of the target element isotope; and evaluating whether a mass deviation correction is needed for the elemental analysis of the target element isotope included in the polyatomic ion; when mass deviation correction is needed, determining a second exact mass (EM2) of the target elemental isotope as a function of a mass number corresponding to the target polyatomic ion and a mass deviation correction corresponding to a reactant in the reaction cell.

34. A non-transitory computer-readable storage device having instructions stored thereon that, when executed by at least one processor, causes the at least one processor to perform the method according to any one of claims 1-7.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted based on the foregoing description.

What is claimed is:

1. A method for controlling mass filtering of polyatomic ions in an ion beam passing through an inductively coupled plasma mass spectrometer (ICP-MS), the method comprising:

determining polyatomic ion mass data representative of the exact mass of a polyatomic ion having a target isotope, wherein the exact mass is based on the target isotope and a cell gas used in the ICP-MS to form the polyatomic ions in the ion beam;

generating a first control signal based on the determined polyatomic ion mass data; and outputting the first control signal to an ICP-MS to filter based on mass the polyatomic ions in the ion beam traveling through the ICP-MS to an ion detector.

2. The method of claim 1, wherein the polyatomic ion mass data comprises the exact mass of the polyatomic ion having the target isotope.

3. The method of claim 2, further comprising storing mass data in memory including storing the polyatomic ion mass data.

4. The method of claim 3, wherein the determining comprises accessing the polyatomic ion mass data stored in memory.

5. The method of claim 2, wherein the determining comprises calculating the exact mass of the polyatomic ion having the target isotope.

6. The method of claim 2, wherein the determining comprises performing a table look up to determine the exact mass of the polyatomic ion having the target isotope.

7. The method of claim 1, further comprising storing mass deviation correction data in memory, wherein the mass deviation correction data is based on the target isotope and the cell gas.

8. The method of claim 1, wherein the ICP-MS comprises a triple quadrupole ICP-MS having first and second mass analyzers controlled to filter ion masses, and the first control signal is output to the second mass analyzer to control one or more voltage signals applied to the second mass analyzer.

9. The method of claim 1, wherein the ICP-MS comprises a single quadrupole ICP-MS having a mass analyzer, and the first control signal is output to the mass analyzer to control mass filtering of the ion beam passing through the mass analyzer.

10. An element analyzer system configurable for use in an inductively coupled plasma mass spectrometer (ICP-MS), comprising:

a user-interface that enables a user to input selections for analyzing a target isotope included in a polyatomic ion; and one or more processors coupled to the user-interface and configured to received data representative of the input selections and further configured to:

determine polyatomic ion mass data representative of the exact mass of a polyatomic ion having a target isotope, wherein the exact mass is based on the target isotope and a cell gas used in the ICP-MS to form the polyatomic ions in the ion beam;

generate a first control signal based on the determined polyatomic ion mass data; and initiate output of the first control signal to an ICP-MS to filter based on mass the polyatomic ions in the ion beam traveling through the ICP-MS.

11. The system of claim 10, wherein the polyatomic ion mass data comprises the exact mass of the polyatomic ion having the target isotope.

12. The system of claim 11, further comprising a memory that stores mass data including the polyatomic ion mass data.

13. The system of claim 12, wherein the one or more processors are configured to access the polyatomic ion mass data stored in the memory.

14. The system of claim 11, wherein the one or more processors are configured to calculate the exact mass of the polyatomic ion having the target isotope.

15. The system of claim 11, wherein the one or more processors are further configured to perform a table look up to determine the exact mass of the polyatomic ion having the target isotope.

16. The system of claim 10, wherein the one or more processors are further configured to store mass deviation correction data in memory, wherein the mass deviation correction data is based on the target isotope and the cell gas.

17. The system of claim 10, wherein the ICP-MS comprises a triple quadrupole ICP-MS having first and second mass analyzers controlled to filter ion masses, and wherein the one or more processors are configured to output the first control signal to the second mass analyzer to control one or more voltage signals applied to the second mass analyzer.

18. The system of claim 17, further comprising a power supply coupled to the second mass analyzer, wherein the power supply generates the one or more voltage signals applied to the second mass analyzer, and wherein the one or more voltage signals comprise a DC voltage signal (U) and an AC voltage signal (Vp) and further comprising applying the U and Vp voltages to quadrupole electrodes in the second mass analyzer to control mass filtering of the ion beam passing through the second mass analyzer.

19. The system of claim 10, wherein the ICP-MS comprises a single quadrupole ICP-MS having a mass analyzer, and the first control signal is output to the mass analyzer to control mass filtering of the ion beam passing through the mass analyzer.

20. An element analyzer system comprising:

an inductively coupled plasma mass spectrometer;

a workstation coupled to the inductively coupled plasma mass spectrometer, wherein the workstation includes:

a user-interface that enables a user to input selections for analyzing a target element isotope included in a polyatomic ion; and one or more processors coupled to the user-interface and configured to received data representative of the input selections and further configured to:

determine a first exact mass (EM1) of the target element isotope;

evaluate whether a mass deviation correction is needed for the elemental analysis of the target element isotope included in the polyatomic ion; and when mass deviation correction is needed, determine a second exact mass (EM2) of the target elemental isotope as a function of a mass number corresponding to the target polyatomic ion and a mass deviation correction corresponding to a reactant in the reaction cell.

* * * * *